US007314185B2

(12) United States Patent
Nishi et al.

(10) Patent No.: US 7,314,185 B2
(45) Date of Patent: Jan. 1, 2008

(54) LIQUID JETTING DEVICE

(75) Inventors: Yasuo Nishi, Hino (JP); Kaoru Higuchi, Tenri (JP); Kazuhiro Murata, Tsukuba (JP); Hiroshi Yokoyama, Tsukuba (JP)

(73) Assignees: Konica Minolta Holdings, Inc. (JP); Sharp Kabushiki Kaishi (JP); National Institute of Advanced Industrial Science and Technology (JP)

( * ) Notice: Subject to any disclaimer, the term of this patent is extended or adjusted under 35 U.S.C. 154(b) by 0 days.

(21) Appl. No.: 10/529,006

(22) PCT Filed: Sep. 22, 2003

(86) PCT No.: PCT/JP03/12099

§ 371 (c)(1),
(2), (4) Date: Mar. 24, 2005

(87) PCT Pub. No.: WO2004/028813

PCT Pub. Date: Apr. 8, 2004

(65) Prior Publication Data

US 2006/0049272 A1 Mar. 9, 2006

(30) Foreign Application Priority Data

Sep. 24, 2002 (JP) ..... 2002-278231
Aug. 13, 2003 (JP) ..... 2003-293043

(51) Int. Cl.
*B05B 1/08* (2006.01)

(52) U.S. Cl. ..... 239/102.1; 239/690; 239/690.1; 239/696; 239/699; 239/102.2; 239/589; 239/596; 239/601; 239/708; 347/55; 347/68

(58) Field of Classification Search ..... 239/589, 239/596, 601, 708, DIG. 19, 690, 67, 68, 239/102.1, 102.2, 425, 696, 690.1, 699; 347/55, 347/68
See application file for complete search history.

(56) References Cited

U.S. PATENT DOCUMENTS 3,060,429 A * 10/1962 Winston ..... 346/11
3,886,565 A * 5/1975 Kojima ..... 347/47
4,281,333 A * 7/1981 Tsuzuki et al. ..... 347/15
4,717,926 A * 1/1988 Hotomi ..... 347/55

(Continued)

FOREIGN PATENT DOCUMENTS

EP 1 275 440 1/2003

(Continued)

*Primary Examiner*—Kevin Shaver
*Assistant Examiner*—Jason Boeckmann
(74) *Attorney, Agent, or Firm*—Cantor Colburn LLP

(57) ABSTRACT

A liquid jetting apparatus (20) to jet a droplet of a charged liquid solution onto a base material, having: a nozzle (21) in which an edge portion thereof is arranged to face the base material K having a receiving surface to receive the jetted droplet, and an inside diameter of the edge portion from which the droplet is jetted is not more than 30 [μm]; a liquid solution supplying section (29) to supply the liquid solution into the nozzle (21); a jetting voltage applying section (25) to apply a jetting voltage to the liquid solution in the nozzle (21); and a convex meniscus forming section (40) to form a state where the liquid solution in the nozzle (21) protrudes from the nozzle edge portion.

12 Claims, 22 Drawing Sheets

U.S. PATENT DOCUMENTS

| | | | | | |
|---|---|---|---|---|---|
| 5,165,601 | A | * | 11/1992 | Rodenberger et al. | 239/690 |
| 5,477,249 | A | * | 12/1995 | Hotomi | 347/48 |
| 6,036,302 | A | * | 3/2000 | Hotomi | 347/55 |
| 6,412,925 | B1 | * | 7/2002 | Takahashi | 347/69 |
| 6,420,476 | B1 | * | 7/2002 | Yamada et al. | 524/575 |
| 6,481,648 | B1 | * | 11/2002 | Zimmermann | 239/690 |
| 6,811,090 | B2 | * | 11/2004 | Yogi et al. | 239/4 |
| 2003/0178507 | A1 | * | 9/2003 | Maria Rijn Van | 239/337 |

FOREIGN PATENT DOCUMENTS

| | | | |
|---|---|---|---|
| JP | 55-140570 | | 11/1980 |
| JP | 62-199451 | | 9/1987 |
| JP | 4-59255 | | 2/1992 |
| JP | 4-338548 | | 11/1992 |
| JP | 5-278212 | | 10/1993 |
| JP | 11-10885 | | 1/1999 |
| JP | 2000-6423 | | 1/2000 |
| JP | 2000-15817 | | 1/2000 |
| JP | 2002-154211 | | 5/2002 |
| JP | 2002-172787 | | 6/2002 |
| JP | 2003-24835 | | 1/2003 |
| JP | 2003-225591 | | 8/2003 |
| WO | WO 02/18058 | * | 3/2002 |

* cited by examiner

FIG.7

| NOZZLE DIAMETER ( μ m) | MAXIMUM ELECTRIC FIELD INTENSITY(V/m) | | COEFFICIENT OF FLUCTUATION (%) |
|---|---|---|---|
| | GAP100 ( μ m) | GAP2000 ( μ m) | |
| 0.2 | $2.001 \times 10^9$ | $2.00005 \times 10^9$ | 0.05 |
| 0.4 | $1.001 \times 10^9$ | $1.00005 \times 10^9$ | 0.09 |
| 1 | $0.401002 \times 10^9$ | $0.40005 \times 10^9$ | 0.24 |
| 8 | $0.0510196 \times 10^9$ | $0.05005 \times 10^9$ | 1.94 |
| 20 | $0.0210476 \times 10^9$ | $0.0200501 \times 10^9$ | 4.98 |
| 50 | $0.00911111 \times 10^9$ | $0.00805 \times 10^9$ | 13.18 |

FIG.19

| No. | CONTROL PATTERN | RESPONSIVENESS |
|---|---|---|
| 1 | Ⓐ | 2 |
| 2 | Ⓑ | 3 |
| 3 | Ⓒ | 3.5 |
| 4 | Ⓓ | 4.0 |
| 5 | Ⓔ | 5.0 |
| 6 | Ⓕ | 3 |
| 7 | Ⓖ | 3.5 |

LIQUID JETTING DEVICE

CROSS REFERENCE TO RELATED APPLICATION

This is a U.S. national stage of application No. PCT/JP2003/012099, filed on 22 Sep. 2003. Priority under 35 U.S.C. §119(a) and 35 U.S.C. 365(b) is claimed from Japanese Application No. 2002-278231, filed 24 Sep. 2002 and Japanese Application No. 2003-293043, filed 13 Aug. 2003, the disclosures of which are also incorporated herein by reference.

FIELD OF THE INVENTION

The present invention relates to a liquid jetting apparatus for jetting liquid to a base material.

BACKGROUND ART

As a conventional inkjet recording method, a piezo method for jetting an ink droplet by changing a shape of an ink passage according to vibration of a piezoelectric element, a thermal method for making a heat generator provided in an ink passage heat to generate air bubbles and jetting an ink droplet according to a pressure change by the air bubbles in the ink passage, and an electrostatic sucking method for charging ink in an ink passage to jet an ink droplet by a electrostatic sucking power of the ink are known.

An ink jet printer described in JP-Tokukaihei-11-277747 is cited as a conventional electrostatic sucking type ink jet printer. The ink jet printer comprises a plurality of convex ink guides for jetting ink from an edge portion thereof, a counter electrode which is arranged to face the edge of each ink guide and is grounded, and a jetting electrode for applying a jetting voltage to ink for each ink guide. Two kinds of the convex ink guides with different widths of slits to guide ink are prepared to have a feature to be able to jet an ink droplet with two kinds of sizes by appropriately using them.

The conventional ink jet printer jets an ink droplet by applying a pulse voltage to the jetting electrode, and guides the ink droplet to the counter electrode side by electric field formed between the jetting electrode and the counter electrode.

However, the above-mentioned inkjet recording method has the following problems.

(1) Limit and Stability of a Minute Liquid Droplet Formation

Since a nozzle diameter is large, a shape of a droplet jetted from a nozzle is not stabilized, and there is a limit of making a droplet minute.

(2) High Applying Voltage

For jetting a minute droplet, miniaturization of a jet opening of the nozzle is an important factor. In a principle of the conventional electrostatic sucking method, since the nozzle diameter is large, electric field intensity of a nozzle edge portion is weak, and therefore, in order to obtain necessary electric field intensity for jetting a droplet, it is necessary to apply a high jetting voltage (for example, extremely high voltage near 2000 [V]). Accordingly, in order to apply a high voltage, a driving control of a voltage becomes expensive.

Moreover, in the patent document 1 as the conventional example, ink jetting is performed only by applying a pulse voltage to the ink, so a high voltage needs to be applied to the electrode to which the pulse voltage is applied. Thus, there is a disadvantage to accelerate the above (2) and (3) problems.

Thereupon, to provide a liquid jetting apparatus capable of jetting a minute droplet is a first object. At the same time, to provide a liquid jetting apparatus capable of jetting a stable droplet is a second object. Further, to provide a liquid jetting apparatus which can reduce an applying voltage and is cheap is a third object.

DISCLOSURE OF THE INVENTION

The present invention has a structure in which the liquid jetting apparatus to jet a droplet of a charged liquid solution onto a base material, comprises:

a liquid jetting head comprising a nozzle to jet the droplet from an edge portion, an inside diameter of the edge portion of the nozzle being not more than 30 [μm];

a liquid solution supplying section to supply the liquid solution into the nozzle;

a jetting voltage applying section to apply a jetting voltage to the liquid solution in the nozzle; and a convex meniscus forming section to form a state where the liquid solution in the nozzle protrudes from the nozzle edge portion.

Hereinafter, the nozzle diameter indicates the inside diameter of the nozzle at the edge portion from which a droplet is jetted (inside diameter at the edge portion of the nozzle). A shape of cross section of a droplet jetting hole in the nozzle is not limited to a round shape. For example, in the case where the cross-sectional shape of the liquid jetting hole is a polygon shape, a star-like shape or other shape, it indicates that the circumcircle of the cross-sectional shape is not more than 30 [μm]. Hereinafter, regarding to the nozzle diameter or the inside diameter at the edge portion of the nozzle, it is to be the same even when other numerical limitations are given. The nozzle radius indicates the length of ½ of the nozzle diameter (inside diameter of the edge portion of the nozzle).

In the present invention, "base material" indicates an object to receive landing of a droplet of the liquid solution jetted, and material thereof is not specifically limited. Accordingly, for example, when applying the above structure to the ink jet printer, a recording medium such as a paper, a sheet or the like corresponds to the base material, and when forming a circuit by using a conductive paste, the base on which the circuit is to be made corresponds to the base material.

In the above structure, the nozzle or the base material is arranged so that a receiving surface where a droplet lands faces the edge portion of the nozzle. The arranging operation to realize the positional relation with each other may be performed by moving either the nozzle or the base material.

Then, the liquid solution is supplied to the inside of the liquid jetting head by the liquid solution supplying section. The liquid solution in the nozzle needs to be in a state of being charged for performing jetting. An electrode exclusively for charging may be provided to apply a voltage needed to charge the liquid solution.

The convex meniscus forming section forms a state where the liquid solution protrudes at the nozzle edge portion (convex meniscus). For forming the convex meniscus, for example, a method such as increasing a pressure in the nozzle to be in the range that a droplet does not drop from the nozzle edge portion is adopted.

Then, before or at the same time of forming the convex meniscus at the nozzle edge portion, the jetting voltage at the position of the convex meniscus is applied to the liquid solution in the liquid jetting head by the jetting voltage applying section. This jetting voltage is set to be in the range where jetting of a droplet is not performed alone, but can be performed in cooperation with the meniscus formation by the convex meniscus forming section. Accordingly, when the convex meniscus is formed at the nozzle edge by the driving voltage for forming the convex meniscus, a droplet of the liquid solution flies from the protruding edge portion of the convex meniscus in a direction perpendicular to the receiving surface of the base material, thereby forming a dot of the liquid solution on the receiving surface of the base material.

In the present invention, since the convex meniscus forming section is provided, it is possible to focus the point to jet a droplet to the top of the convex meniscus, and a droplet can be jetted with a smaller jetting force than that in the case where the liquid level is flat or concave. Thus, by actively utilizing the reduction of the jetting voltage by smoothly jetting a droplet and the difference of the jetting voltage depending upon the position of the meniscus, the jetting voltage can be further reduced.

Conventionally, both of the convex meniscus formation and jetting a droplet are performed by applying a voltage to the liquid solution, so that high voltage for performing both of them at the same time is required. However, in the present invention, the convex meniscus formation is performed by the convex meniscus forming section which is different from the jetting voltage applying section for applying a voltage to the liquid solution, and jetting of a droplet is performed by applying a voltage by the jetting voltage applying section, so that a voltage value applied to the liquid solution at the time of jetting can be reduced.

Further, in the present invention, the electric field intensity becomes high by concentrating the electric filed at the nozzle edge portion with the use of the nozzle having a super minute diameter which cannot be found conventionally, and at that time, an electrostatic force which is generated between the distance to an image charge on the base material side is induced, thereby a droplet flies.

Accordingly, jetting a droplet can be performed with a lower voltage than that which has been conventionally considered, even with the minute nozzle, and can be favorably performed even when the base material is made of conductive material or insulating material.

In this case, jetting a droplet can be performed even when there is no counter electrode facing the edge portion of the nozzle. For example, in the case that the base material is arranged to face the nozzle edge portion in the state where there is no counter electrode, when the base material is a conductor, an image charge with reversed polarity is induced at a position which is plane symmetric with the nozzle edge portion with respect to the receiving surface of the base material as a standard, and when the base material is an insulator, an image charge with reversed polarity is induced at a symmetric position which is defined by dielectric constant of the base material with respect to the receiving surface of the base material as a standard. Flying of a droplet is performed by an electrostatic force between the electric charge induced at the nozzle edge portion and the image charge.

Thereby, the number of components in the structure of the apparatus can be reduced. Accordingly, when applying the present invention to a business ink jet system, in can contribute to improvement of productivity of the whole system, and also the cost can be reduced.

However, although the structure of the present invention can eliminate the use of a counter electrode, the counter electrode may be used at the same time. When the counter electrode is used at the same time, preferably, the base material is arranged to be along the facing surface of the counter electrode and the facing surface of the counter electrode is arranged to be perpendicular to a direction of jetting a droplet from the nozzle, thereby it becomes possible to use an electrostatic force by the electric field between the nozzle and the counter electrode for inducing a flying electrode. Moreover, by grounding the counter electrode, an electric charge of a charged droplet can be released via the counter electrode in addition to discharging the electric charge to the air, so that the effect to reduce storage of electric charges can also be obtained. Thus, using the counter electrode at the same time can be described as a preferable structure.

In addition to the above structure, an operation control section to control the respective applications of the driving voltage for driving the convex meniscus forming section and a jetting voltage by the jetting voltage applying section may be provided, and this operation control section may have a structure to comprise a first jetting control unit for controlling the application of the driving voltage of the convex meniscus forming section when jetting a droplet while controlling the application of the jetting voltage by the jetting voltage applying section.

In this structure, by forming the convex meniscus according to the need of jetting in the state where the jetting voltage is preliminary applied to the liquid solution by the first jetting control unit, the electrostatic force necessary for jetting a droplet from the edge portion of the nozzle can be obtained, thereby jetting a droplet is performed.

In addition to the above structure, an operation control section to control an application of the driving voltage of the convex meniscus forming section and a application by the jetting voltage applying section may be provided, and this operation control section may have a structure to comprise a second jetting control unit for performing a protruding operation of the liquid solution by the convex meniscus forming section and the application of the jetting voltage in synchronization with each other.

In this structure, the second jetting control unit performs forming the convex meniscus and jetting a droplet in synchronization with each other, so that jetting a droplet by applying the jetting voltage as well as forming the convex meniscus can be performed, thereby shortening the time interval between the two operations.

Here, the above described "synchronization" includes not only the case where the period in which the protruding operation of the liquid solution is performed accords with the period to apply the jetting voltage in regard to the timing, but also the case where at least the period necessary for jetting a droplet overlaps even if there is a difference in the start and end timings between the one period and the other period.

Moreover, in addition to the above described respective structure, the operation control section may comprise a liquid stabilization control section to perform an operation control to draw a liquid level at the nozzle edge portion to an inside after the protruding operation of the liquid solution and the application of the jetting voltage.

In this structure, after jetting a droplet, the droplet at the nozzle edge portion is sucked to the inside, for example, by reducing the internal pressure of the nozzle or the like. When a droplet flies from the convex meniscus, the convex meniscus may vibrate due to the flying of the droplet, and this case causes the need to perform the next jetting after waiting the vibration of the convex meniscus to stop to prevent the effect of the vibration. In the above structure, even when the convex meniscus vibrates, because the convex state once disappears by temporary sucking the liquid level at the nozzle edge portion to the inside of the nozzle, and also because of the rectification by passing the inside of the nozzle with lower conductance, the liquid level vibration state is resolved. Accordingly, the vibration of the liquid level is actively and promptly stopped, so that the next operations of forming the convex meniscus and jetting can be performed without waiting a certain waiting time for the vibration to stop after sucking like the conventional one.

Moreover, in addition to the above described structure, the convex meniscus forming section may comprise a piezo element to change a capacity in the nozzle.

In this structure, the formation of the convex meniscus is performed so that the piezo element changes the capacity in the nozzle by changing the shape thereof to increase the nozzle pressure.

Drawing the liquid level at the nozzle edge portion to the inside is performed so that the capacity in the nozzle is changed by the shape change of the piezo element to decrease the nozzle pressure. By forming the convex meniscus by the capacity change of the piezo element, there is no limitation to the liquid solution and it is possible to drive at high frequency.

Moreover, in addition to the above described structure, the convex meniscus forming section may comprise a heater to generate an air bubble in the liquid solution in the nozzle.

In this structure, the formation of the convex meniscus is performed so that air bubbles are formed by evaporation of the liquid solution with the heat of the heater to increase the nozzle pressure. In the present invention, in principle, the jetting liquid solution is limited, however, structurally, it is simple, excellent in arranging nozzles in high density, and is sufficient for environmental responsiveness in comparison to the case of using a driving element such as a piezo element or an electrostatic actuator.

Moreover, in addition to the above described structure, the structure may be such that the jetting voltage applying section applies a jetting voltage V satisfying the following equation (1).

$$h\sqrt{\frac{\gamma\pi}{\varepsilon_0 d}} > V > \sqrt{\frac{\gamma k d}{2\varepsilon_0}} \quad (1)$$

where, $\gamma$: surface tension of liquid solution [N/m], $\epsilon_0$: electric constant [F/m], d: nozzle diameter [m], h: distance between nozzle and base material [m], k: proportionality constant dependent on nozzle shape ($1.5<k<8.5$).

In this structure, the jetting voltage V in the range of the above equation (1) is applied to the liquid solution in the nozzle. In the above equation (1), the left term as a standard of the upper limit of the jetting voltage V indicates the lowest limit jetting voltage in the case of performing jetting a droplet by the electric field between the nozzle and the counter electrode of the conventional one. In the present invention, as described above, by the effect of the electric field concentration due to the super miniaturization of the nozzle, jetting a super minute droplet can be realized even if the jetting voltage V is set to be lower than the conventional lowest limit jetting voltage, which was not realized by the conventional technique.

In the above equation (1), the right term as a standard of the lower limit of the jetting voltage V indicates the lowest limit jetting voltage of the present invention for jetting a droplet against the surface tension by the liquid solution at the nozzle edge portion. That is, when a voltage lower than this lowest limit jetting voltage is applied, jetting a droplet is not performed, but for example, by defining a value higher than this lowest limit jetting voltage as a boarder as a jetting voltage, and by switching a voltage value lower than this and the jetting voltage, on-off control of the jetting operation can be performed. In this case, the lower voltage value to switch to the off state of the jetting is preferably close to the lowest limit jetting voltage. Thereby, the voltage change width in the on-off switch can be narrow, and thus, improving responsiveness.

Moreover, in addition to the above described structure, the nozzle may be formed with a material having an insulating property, or at least the edge portion of the nozzle may be formed with a material having an insulating property.

Here, the insulating property indicates dielectric breakdown strength of not less than 10[kV/mm], preferably not less than 21[kV/mm], and more preferably not less than 30 [kV/mm]. The dielectric breakdown strength indicates "strength for dielectric breakdown" described in JIS-C2110, and a value measured by a measuring method described in JIS-C2110.

By forming the nozzle in this way, discharge from the nozzle edge portion can effectively be suppressed, and the liquid can be jetted in the state where charging of electric charges of the liquid solution was effectively performed, so that jetting can be smoothly and favorably performed.

Moreover, in addition to the above described structure, the nozzle diameter may be less than 20[μm].

Thereby, electric field intensity distribution becomes narrow. Therefore, the electric field can be concentrated. This results in making a droplet to be formed minute and stabilizing the shape thereof, and reducing the total applying voltage. The droplet just after jetted from the nozzle is accelerated by an electrostatic force acting between the electric field and the charge. However, the electric field rapidly decreases with the droplet moves away from the nozzle. Thus, thereafter, the droplet decreases the speed by air resistance. However, the minute droplet with concentrated electric field is accelerated by an image force as it approaches the counter electrode. By balancing the deceleration by air resistance and the acceleration by the image force, the minute droplet can stably fly and landing accuracy can be improved.

Moreover, the inside diameter of the nozzle may be not more than 10 [μm].

Thereby, the electric field can further be concentrated, so that a droplet can further be made minute and the effect to the electric field intensity distribution by the distance change to the counter electrode when flying can be reduced. This results in reducing the effects to the droplet shape or the landing accuracy by the positional accuracy of the counter electrode or, the property or the thickness of the base material.

Moreover, the inside diameter of the nozzle may be not more than 8 [μm].

Thereby, the electric field can further be concentrated, so that a droplet can further be made minute and the effect to the electric field intensity distribution by the distance change to the counter electrode when flying can be reduced. This results in reducing the effects to the droplet shape or the landing accuracy by the positional accuracy of the counter electrode or, the property or the thickness of the base material.

Further, with the degree of the electric field concentration becomes high, the effect of electric field crosstalk which is a problem when arranging nozzles in high density at the time of using a plurality of nozzles is reduced, enabling to arrange the nozzles with further high density.

Moreover, the inside diameter of the nozzle may be not more than 4 [μm]. With this structure, the electric field can significantly be concentrated, thus, making maximum electric field intensity high, and a droplet can be super minute with a stable shape and the initial speed of the droplet can be increased. Thereby, flying stability improves, resulting in further improving the landing accuracy and jetting responsiveness.

Further, with the degree of the electric field concentration becomes high, the effect of electric field crosstalk which is a problem when arranging nozzles with high density at the time of using a plurality of nozzles is reduced, enabling to arrange the nozzles with further high density.

Moreover, the inside diameter of the nozzle is preferably more than 0.2 [μm]. By making the inside diameter of the nozzle be more than 0.2 [μm], charging efficiency of a droplet can be improved. Thus, jetting stability can be improved.

Further, in each above described structure, preferably the nozzle is formed with an electrical insulating material, and an electrode for applying a jetting voltage is inserted in the nozzle or a plating to function as the electrode is formed.

Further, preferably the nozzle is formed with an electrical insulating material, an electrode for applying a jetting voltage is inserted in the nozzle or a plating to function as the electrode is formed, and an electrode for jetting is also provided on the outside of the nozzle.

The electrode for jetting outside the nozzle is, for example, provided at the end surface of the edge portion side of the nozzle, or the entire circumference or a part of the side surface of the edge portion side of the nozzle.

Further, in addition to the operational effects by the above described structures, a jetting force can be improved. Thus, a droplet can be jetted with low voltage even when further making the nozzle diameter minute.

Further, preferably, the base material is formed with a conductive material or an insulating material.

Further, preferably, the jetting voltage to be applied is not more than 1000V.

By setting the upper limit of the jetting voltage in this way, jetting control can be made easy and durability of the apparatus can be easily improved.

Further, preferably, the jetting voltage to be applied is not more than 500V.

By setting the upper limit of the jetting voltage in this way, jetting control can be further made easy and durability of the apparatus can be improved more easily.

Further, preferably, a distance between the nozzle and the base material is not more than 500 [μm], because high landing accuracy can be obtained even when making the nozzle diameter minute.

Further, preferably, the structure is such that a pressure is applied to the liquid solution in the nozzle.

Further, when jetting is performed at a single pulse, a pulse width Δt not less than a time constant I determined by the following equation (2) may be applied.

$$\tau = \frac{\varepsilon}{\sigma} \tag{2}$$

where, ε: dielectric constant of liquid solution [F/m], and σ: conductivity of liquid solution [S/m].

BRIEF DESCRIPTION OF THE DRAWINGS

FIG. 7 is a chart showing maximum electric field intensity under each condition of FIG. 1 to FIG. 6;

FIG. 19 is a chart showing comparative study results;

BEST MODE FOR CARRYING OUT THE INVENTION

A nozzle diameter of a liquid jetting apparatus described in the following each embodiment is preferably not more than 30 [μm], more preferably less than 20 [μm], even more preferably not more than 10 [μm], even more preferably not more than 8 [μm], and even more preferably not more than 4 [μm]. Also, the nozzle diameter is preferably more than 0.2 [μm]. Hereinafter, in regard to a relation between the nozzle diameter and an electric field intensity, descriptions will be hereafter made with reference to FIG. 1A to FIG. 6B. In correspondence with FIG. 1A to FIG. 6B, electric field intensity distributions in cases of the nozzle diameters being ø0.2, 0.4, 1, 8 and 20 [μm], and a case of a conventionally-used nozzle diameter being ø50 [μm] as a reference are shown.

Here, in FIG. 1A to FIG. 6B, a nozzle center position C indicates a center position of a liquid jetting surface of a liquid jetting hole at a nozzle edge. Further, FIG. 1A, FIG. 2A, FIG. 3A, FIG. 4A, FIG. 5A, and FIG. 6A indicate electric field intensity distributions when the distance between the nozzle and an counter electrode is set to 2000 [μm], and FIG. 1B, FIG. 2B, FIG. 3B, FIG. 4B, FIG. 5B, and FIG. 6B indicate electric field intensity distributions when the distance between the nozzle and the counter electrode is set to 100 [μm]. Here, an applying voltage is set constant to 200 [V] in each condition. A distribution line in FIG. 1A to FIG. 6B indicates a range of electric charge intensity from $1\times10^6$ [V/m] to $1\times10^7$ [V/m].

FIG. 7 shows a chart indicating maximum electric field intensity under each condition.

Figure 1A:
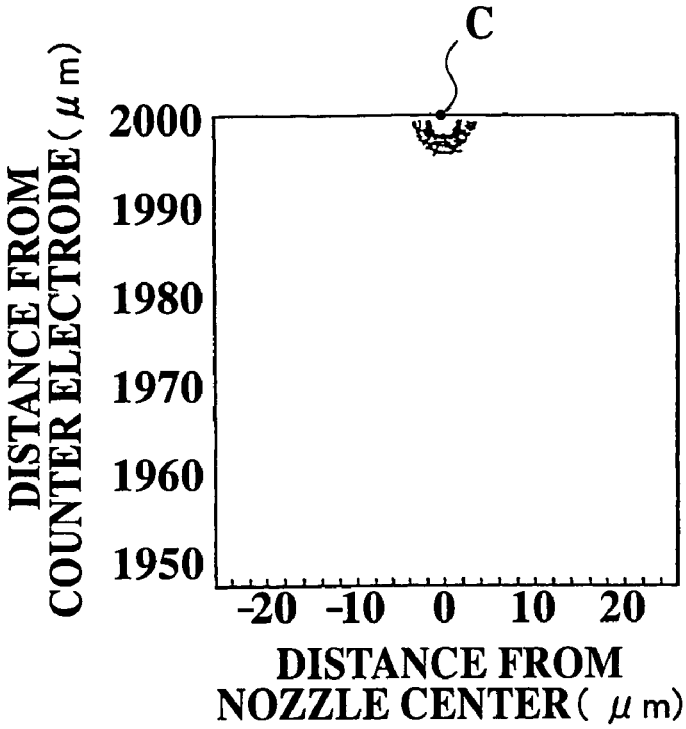
FIG. 1A is a view showing an electric field intensity distribution with a nozzle diameter as ø0.2 [μm] and with a distance from a nozzle to a counter electrode set to 2000 [μm]
Figure 1B:
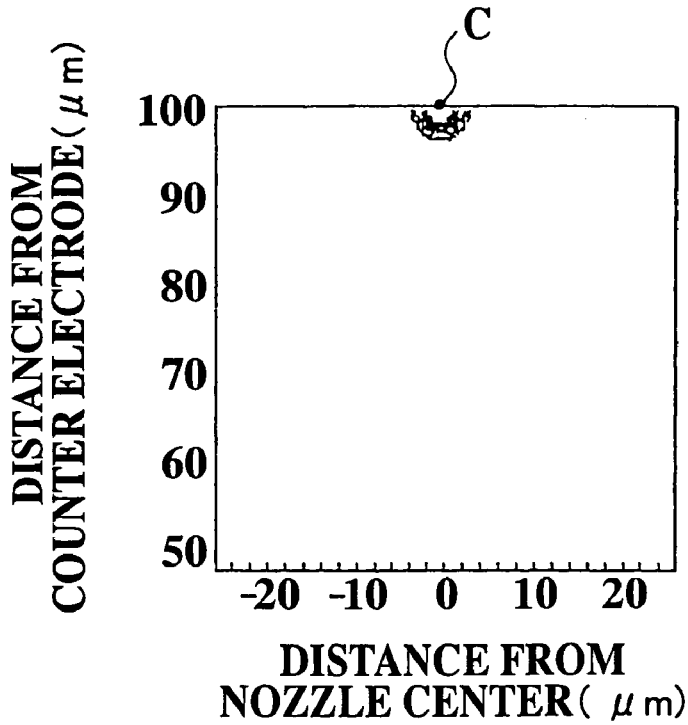
FIG. 1B is a view showing an electric field intensity distribution with the distance from the nozzle to the counter electrode set to 100 [μm]
Figure 2A:
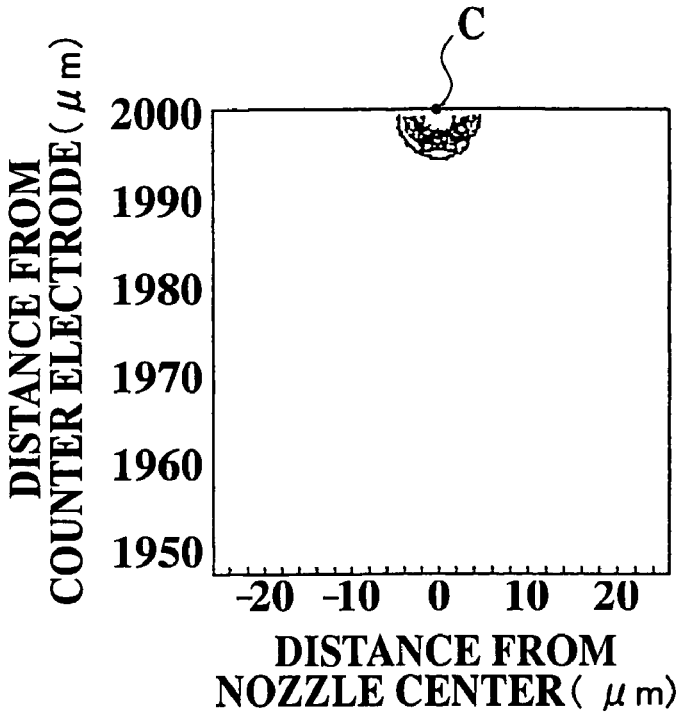
FIG. 2A is a view showing an electric field intensity distribution with the nozzle diameter as ø0.4 [μm] and with the distance from the nozzle to the counter electrode set to 2000 [μm]
Figure 2B:
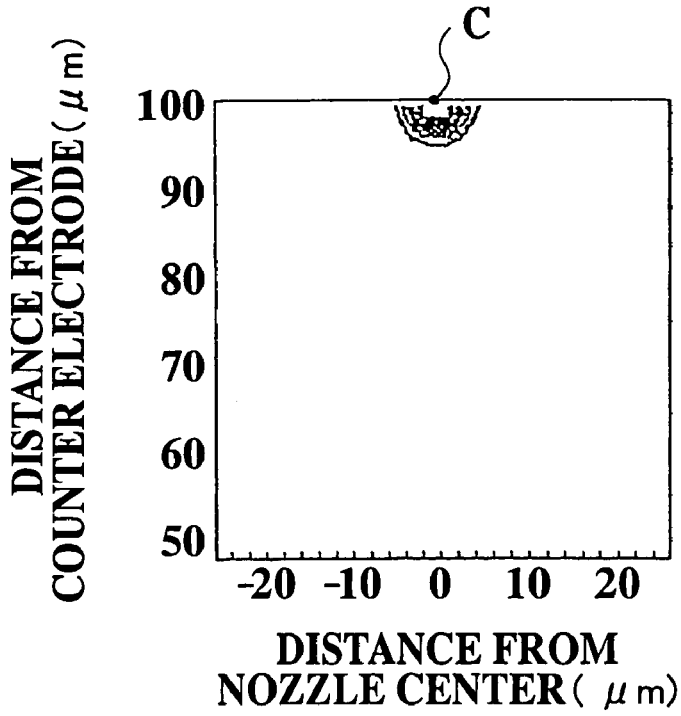
FIG. 2B is a view showing an electric field intensity distribution with the distance from the nozzle to the counter electrode set to 100[μm]
Figure 3A:
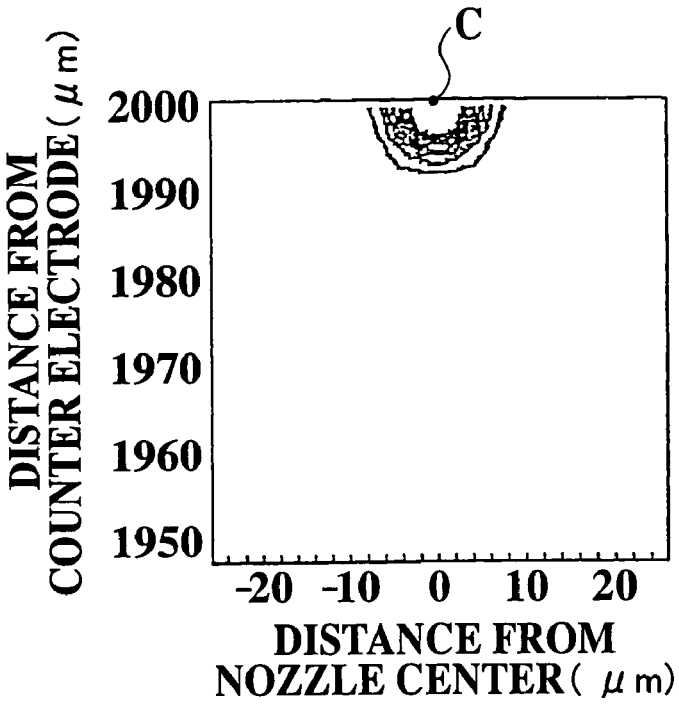
FIG. 3A is a view showing an electric field intensity distribution with the nozzle diameter as ø1 [μm] and with a distance from the nozzle to the counter electrode set to 2000[μm]
Figure 3B:
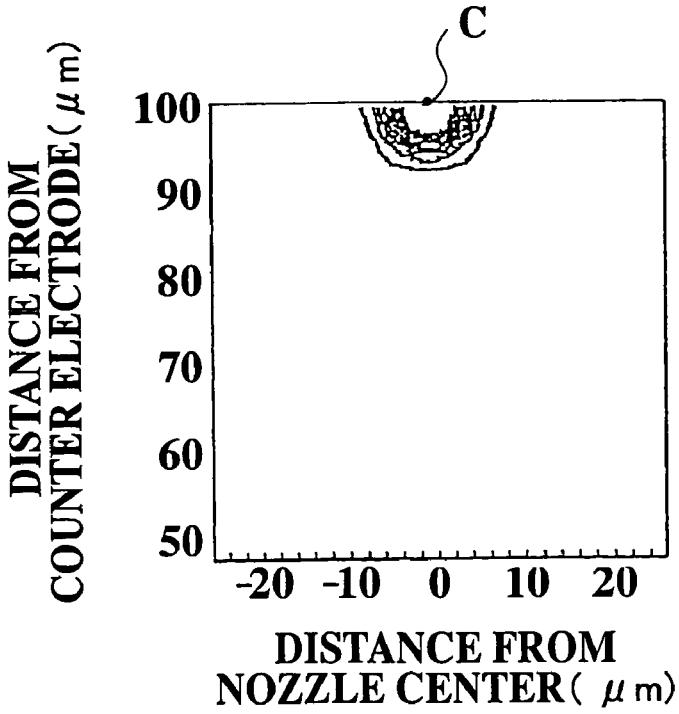
FIG. 3B is a view showing an electric field intensity distribution with the distance from the nozzle to the counter electrode set to 100 [μm]
Figure 4A:
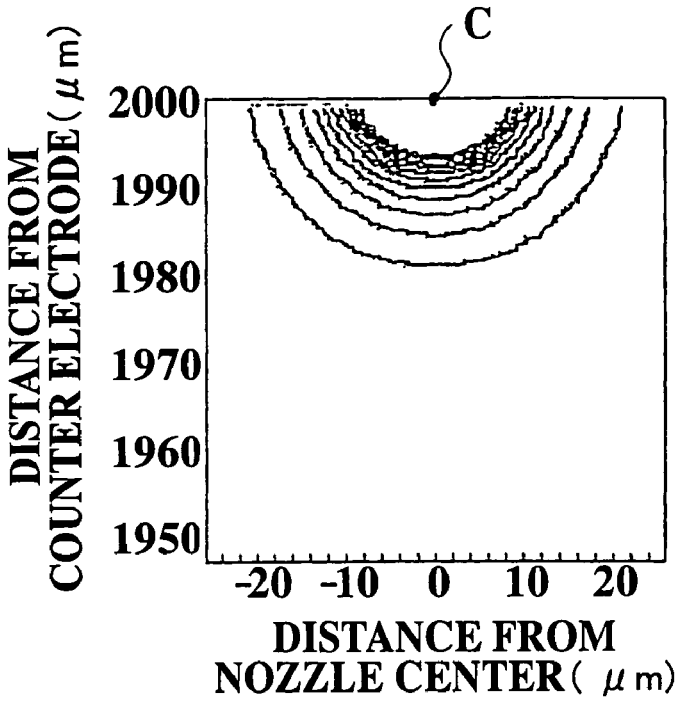
FIG. 4A is a view showing an electric field intensity distribution with the nozzle diameter as ø8 [μm] and with the distance from the nozzle to the counter electrode set to 2000 [μm]
Figure 4B:
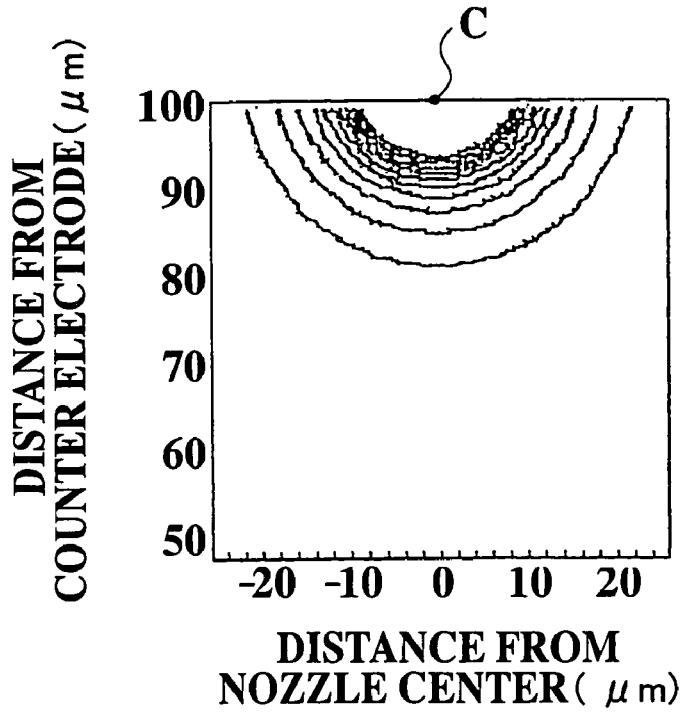
FIG. 4B is a view showing an electric field intensity distribution with the distance from the nozzle to the counter electrode set to 100 [μm]
Figure 5A:
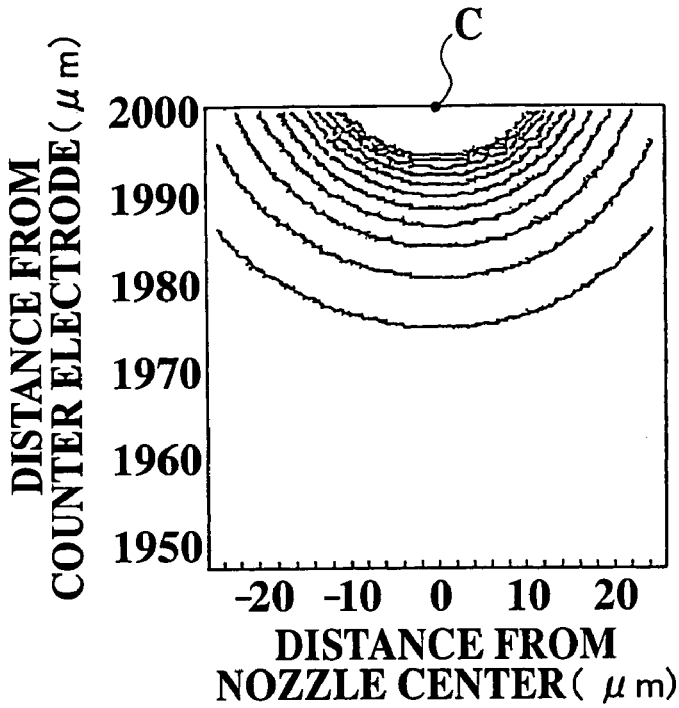
FIG. 5A is a view showing an electric field intensity distribution with the nozzle diameter as ø20 [μm] and with the distance from the nozzle to the counter electrode set to 2000 [μm]
Figure 5B:
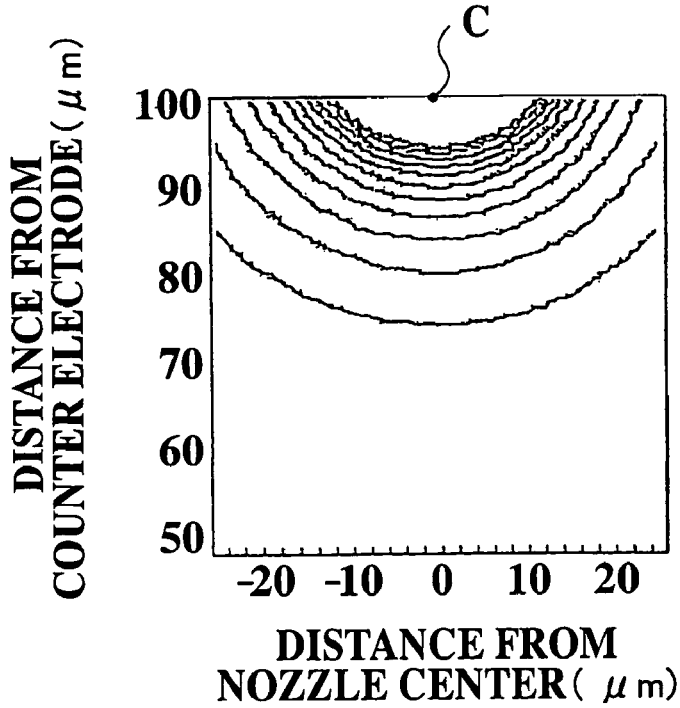
FIG. 5B is a view showing an electric field intensity distribution with the distance from the nozzle to the counter electrode set to 100 [μm]
Figure 6A:
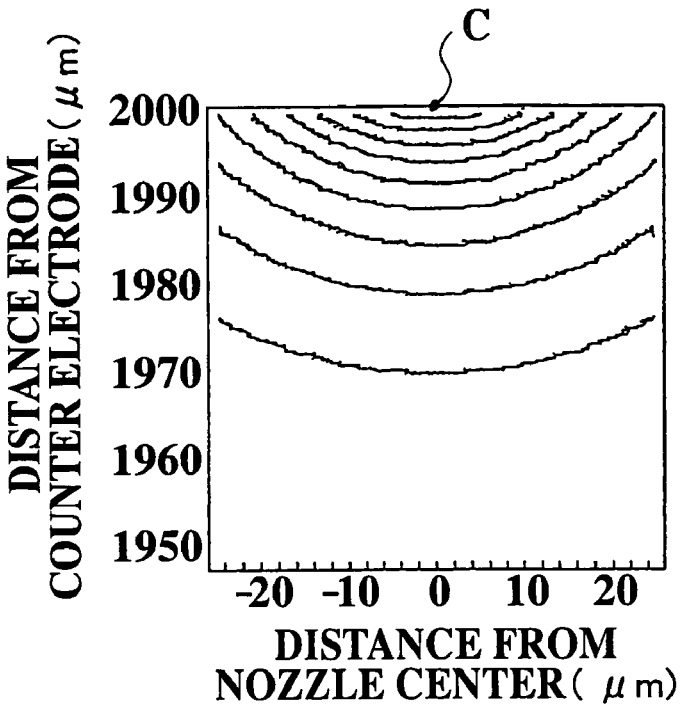
FIG. 6A is a view showing an electric field intensity distribution with the nozzle diameter as ø50 [μm] and with the distance from the nozzle to the counter electrode set to 2000 [μm]
Figure 6B:
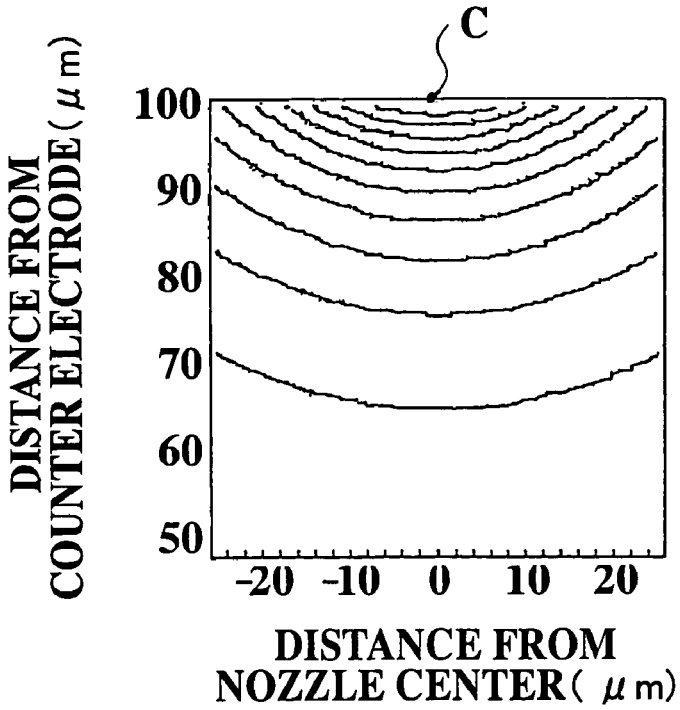
FIG. 6B is a view showing an electric field intensity distribution with the distance from the nozzle to the counter electrode set to 100 [μm]

According to FIG. 5A and FIG. 5B, the fact that the electric field intensity distribution spreads to a large area if the nozzle diameter is not less than ø20 [μm], was comprehended. Further, according to the chart of FIG. 7, the fact that the distance between the nozzle and the counter electrode has an influence on the electric field intensity was comprehended.

From these things, when the nozzle diameter is not more than ø8 [μm] (see FIG. 4A and FIG. 4B), the electric field intensity is concentrated and change of a distance to the counter electrode scarcely has an influence on the electric field intensity distribution. Therefore, when the nozzle diameter is not more than ø8 [μm], it is possible to perform a stable jetting without suffering influence of position accuracy of the counter electrode, and unevenness of base material property and thickness. Next, a relation between the nozzle diameter of the nozzle and the maximum electric field intensity and an intense electric field area when a liquid level is at the edge position of the nozzle is shown in FIG. 8.

Figure 8:
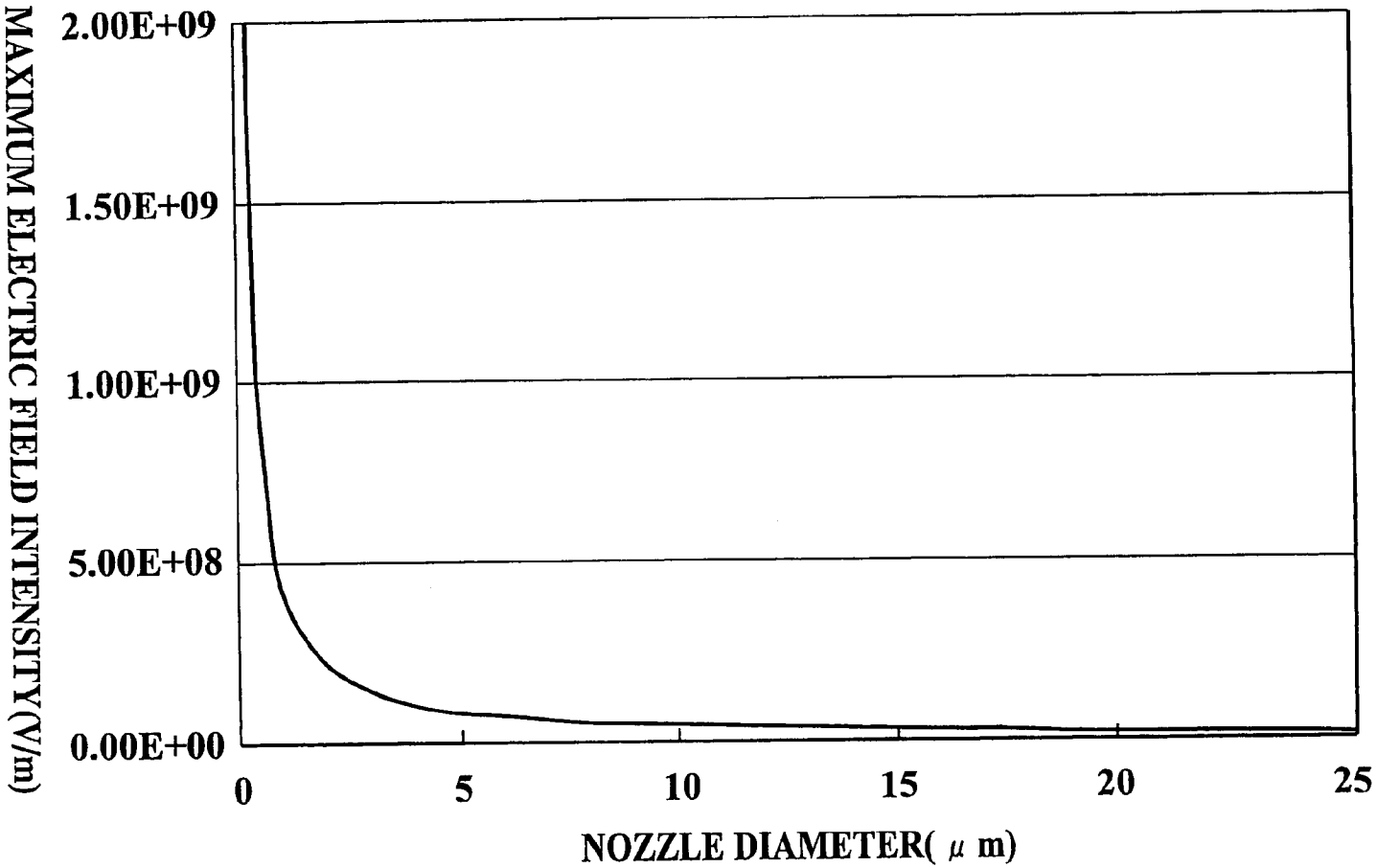
FIG. 8 is a diagram showing a relation between the nozzle diameter of the nozzle, and maximum electric field intensity and an intense electric field area at a meniscus.

According to the graph shown in FIG. 8, when the nozzle diameter is not more than ø4 [μm], the fact that the electric field concentration grows extremely large and the maximum electric field intensity is made high was comprehended. Thereby, since it is possible to make an initial jetting speed of the liquid solution large, flying stability of a droplet is increased and a moving speed of an electric charge at the nozzle edge portion is increased, thereby jetting responsiveness improves.

Continuously, in regard to maximum electric charge amount chargeable to a jetted droplet, description will be made hereafter. Electric charge amount chargeable to a droplet is shown as the following equation (3), in consideration of Rayleigh fission (Rayleigh limit) of a droplet.

$$q = 8\times\pi\times\sqrt{\varepsilon_0\times\gamma\times\frac{d_0^3}{8}} \tag{3}$$

where, q is electric charge amount [C] giving Rayleigh limit, $\epsilon_0$ is electric constant [F/m], γ is surface tension of the liquid solution [N/m], and $d_0$ is diameter [m] of the droplet.

The closer to a Rayleigh limit value the electric charge amount q calculated by the above-mentioned equation (3) is, the stronger an electrostatic force becomes even with the same electric field intensity, thereby improving jetting stability. However, when it is too close to the Rayleigh limit value, conversely a dispersion of the liquid solution occurs at a liquid jet opening of the nozzle, and there is lack of jetting stability.

Figure 9:
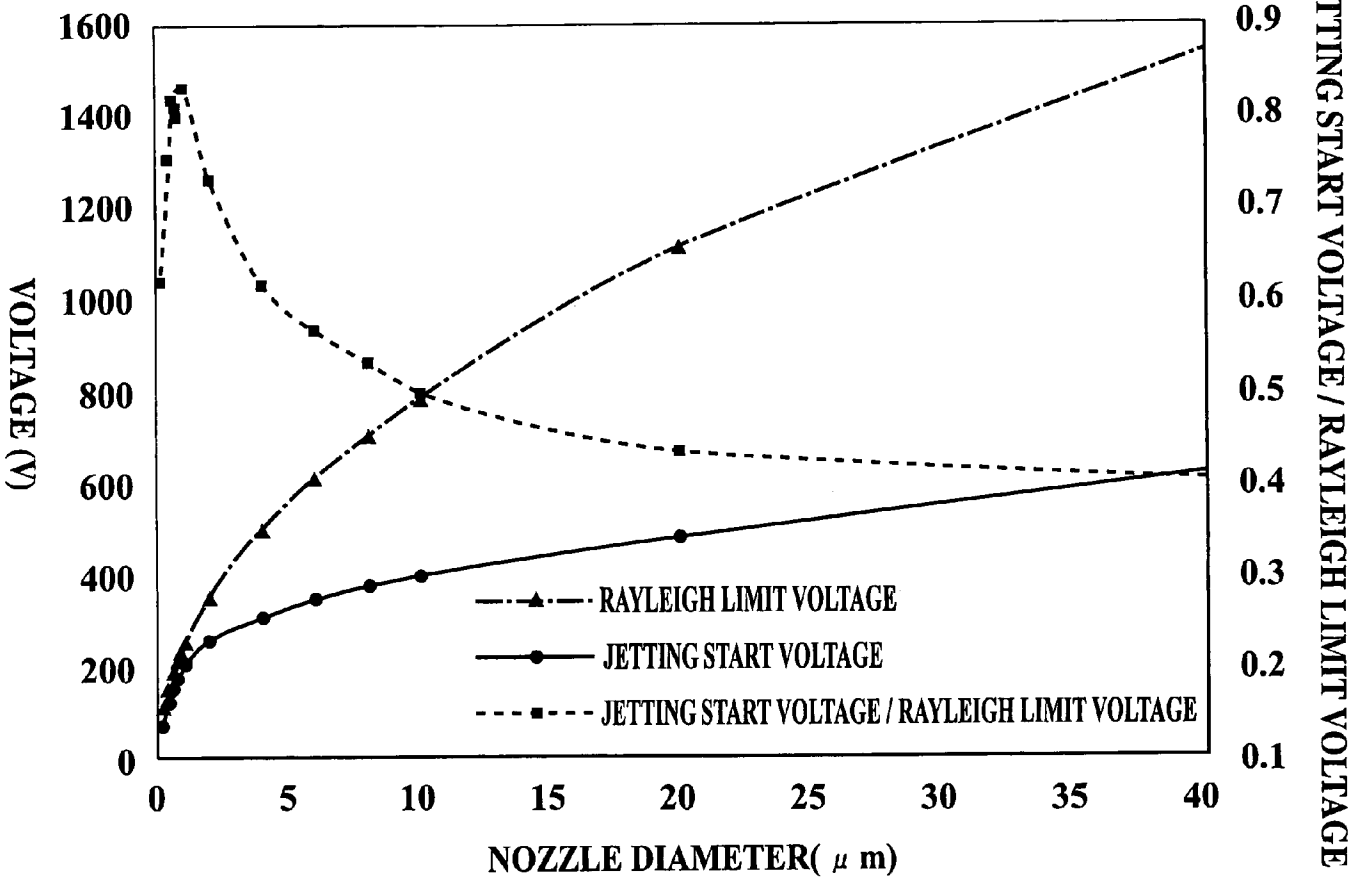
FIG. 9 is a diagram showing a relation among the nozzle diameter of the nozzle, a jetting start voltage at which a droplet jetted at the meniscus starts flying, a voltage value at Rayleigh limit of the initial jetted droplet, and a ratio of the jetting start voltage to the Rayleigh limit voltage.

Here, FIG. 9 is a graph showing a relation among the nozzle diameter of the nozzle, a jetting start voltage at which a droplet jetted at the nozzle edge portion starts flying, a voltage value at Rayleigh limit of the initial jetted droplet, and a ratio of the jetting start voltage to the Rayleigh limit voltage.

From the graph shown in FIG. 9, within the range of the nozzle diameter from ø0.2 [μm] to ø4 [μm], the ratio of the jetting start voltage and the Rayleigh limit voltage value exceeds 0.6, and a favorable result of electric charge efficiency of a droplet is obtained. Thereby, it is comprehended that it is possible to perform a stable jetting within the range.

Figure 10:
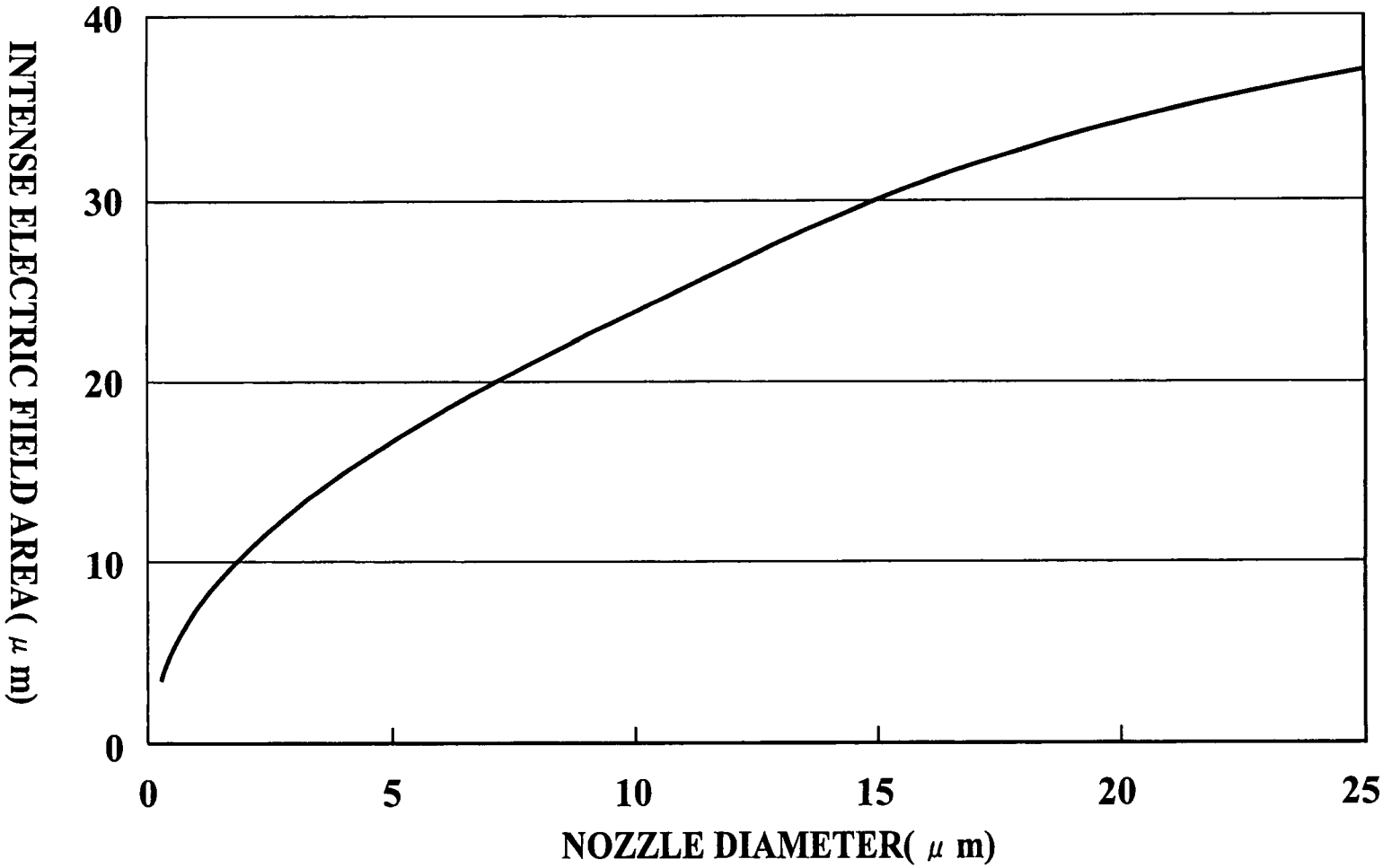
FIG. 10 is a graph described by a relation between the nozzle diameter and the intense electric field area at the meniscus.

For example, in a graph represented by a relation between a nozzle diameter and an intense electric field (not less than $1\times10^6$ [V/m]) area at the nozzle edge portion shown in FIG. 10, the fact that an area of the electric field concentration becomes extremely narrow when the nozzle diameter is not more than ø0.2 [μm] is indicated. Thereby, the fact that a jetted droplet is not able to sufficiently receive energy for acceleration and flying stability is reduced is indicated. Therefore, preferably the nozzle diameter is set to more than ø0.2 [μm].

First Embodiment (Whole Structure of Liquid Jetting Apparatus)

Figure 11:
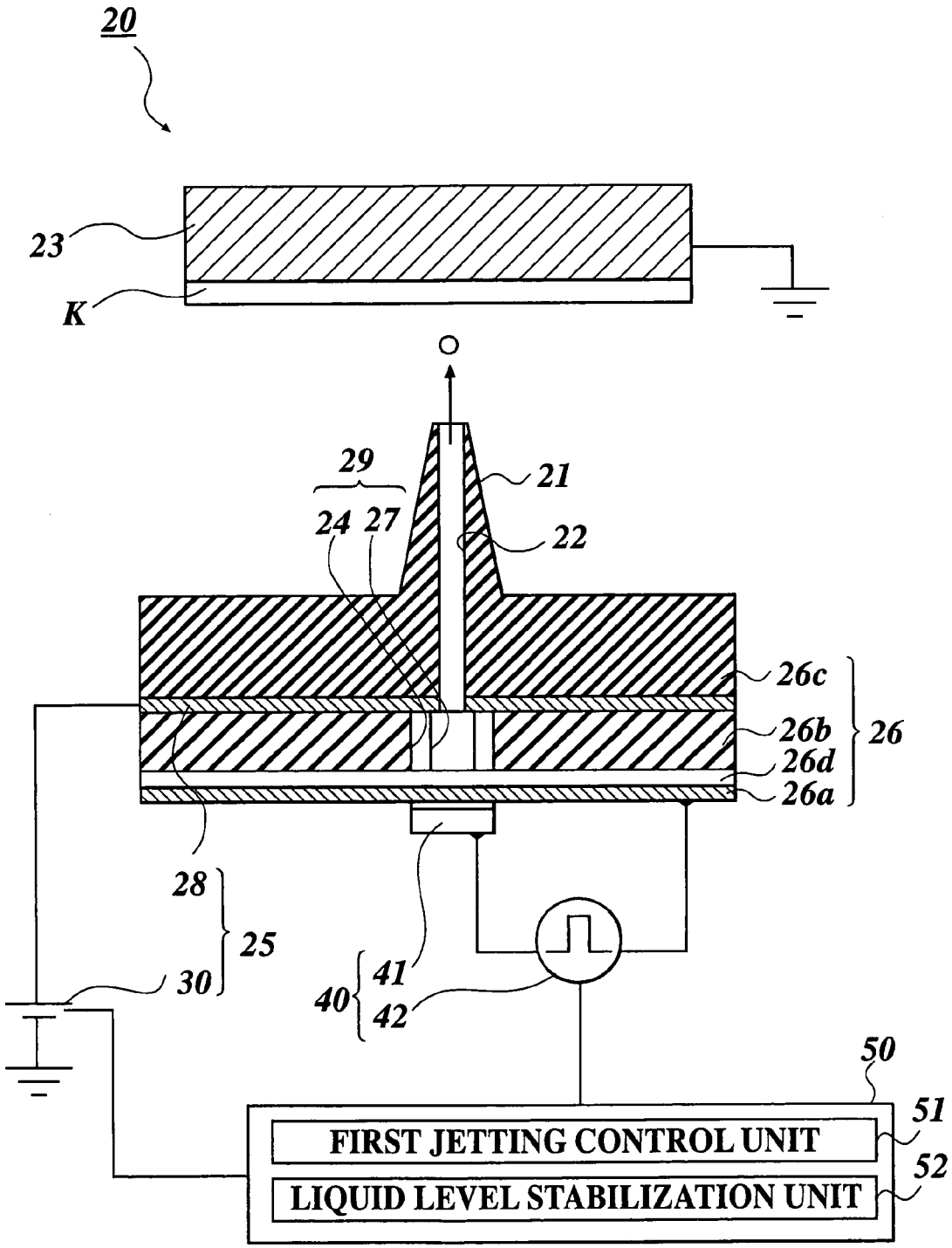
FIG. 11 is a sectional view along the nozzle of the liquid jetting apparatus in the first embodiment.
Figure 12A:
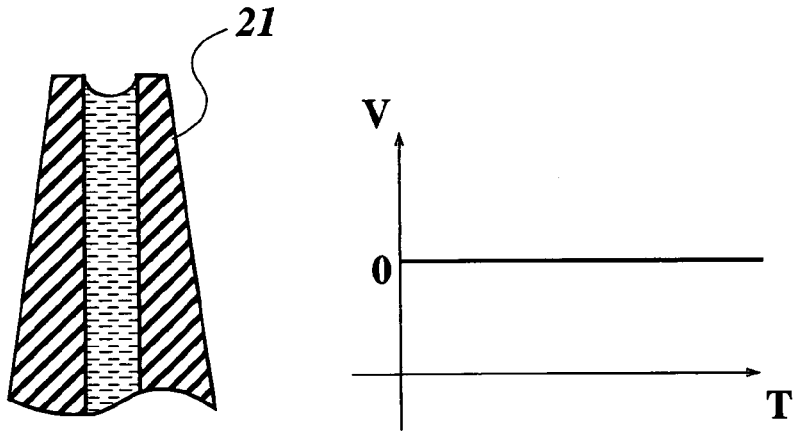
FIG. 12A is an explanation view of a relation between a jetting operation of liquid solution and a voltage applied to the liquid solution in a state where the jetting is not performed.
Figure 12B:
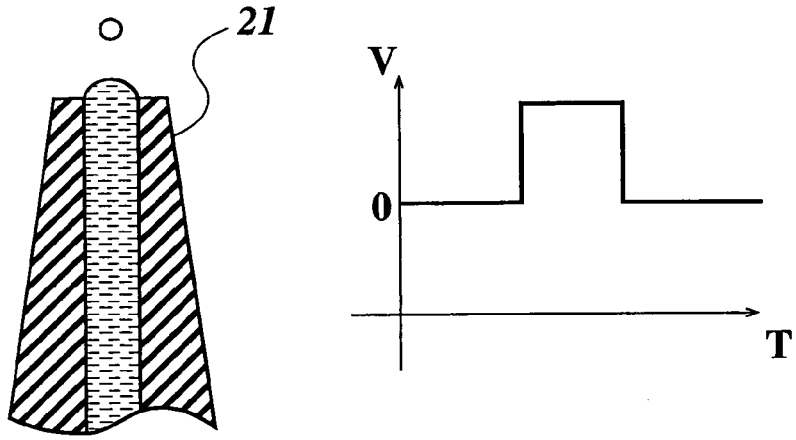
FIG. 12B is an explanation view showing the jetting state.
Figure 12C:
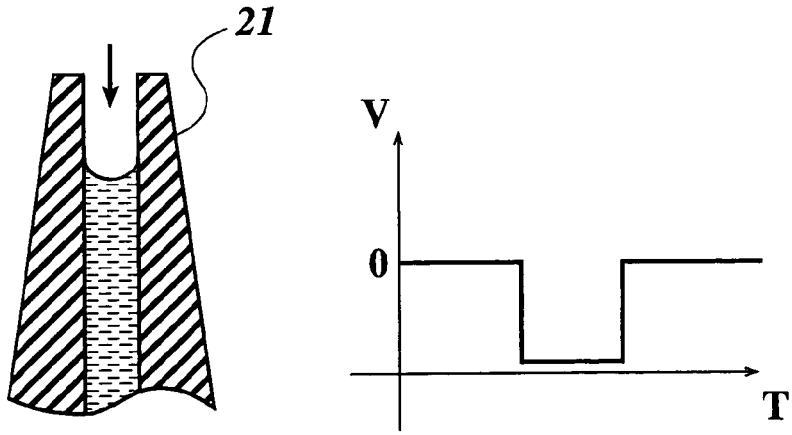
FIG. 12C is an explanation view showing a state after the jetting.

A liquid jetting apparatus 20 as the first embodiment of the present invention will be described below with reference to FIG. 11 to FIGS. 12. FIG. 11 is a sectional view along a nozzle 21 to be described later of the liquid jetting apparatus 20, and FIGS. 12 are explanation views of a relation between a jetting operation of the liquid solution and a voltage applied to the liquid solution, wherein FIG. 12A shows a state where the jetting is not performed, FIG. 12B shows a state where the jetting is performed, and FIG. 12C shows a state after the jetting.

The liquid jetting apparatus 20 comprises the nozzle 21 having a super minute diameter for jetting a droplet of chargeable liquid solution from its edge portion, a counter electrode 23 which has a facing surface to face the edge portion of the nozzle 21 and supports a base material K receiving a droplet at the facing surface, a liquid solution supplying section 29 for supplying the liquid solution to a passage 22 in the nozzle 21, a jetting voltage applying section 25 for applying a jetting voltage to the liquid solution in the nozzle 21, a convex meniscus forming section 40 for forming a state where the liquid solution in the nozzle 21 protrudes to be a convex shape from the edge portion of the nozzle 21, and an operation control section 50 for controlling applying a driving voltage of the convex meniscus forming section 40 and a jetting voltage by the jetting voltage applying section 25. The above-mentioned nozzle 21, a partial structure of the liquid solution supplying section and a partial structure of the jetting voltage applying section 25 are integrally formed as a liquid jetting head.

In FIG. 11, for the convenience of a description, a state where the edge portion of the nozzle 21 faces upward and the counter electrode 23 is provided above the nozzle 21 is illustrated. However, practically, the apparatus is so used that the nozzle 21 faces in a horizontal direction or a lower direction than the horizontal direction, more preferably, the nozzle 21 faces perpendicularly downward.

(Liquid Solution)

As an example of the liquid solution jetted by the above-mentioned liquid jetting apparatus 20, as inorganic liquid, water, $COCl_2$, HBr, $HNO_3$, $H_3PO_4$, $H_2SO_4$, $SOCl_2$, $SO_2CL_2$, $FSO_2H$ and the like can be cited. As organic liquid, alcohols such as methanol, n-propanol, isopropanol, n-butanol, 2-methyl-1-propanol, tert-butanol, 4-metyl-2-pentanol, benzyl alcohol, α-terpineol, ethylene glycol, glycerin, diethylene glycol, triethylene glycol and the like; phenols such as phenol, o-cresol, m-cresol, p-cresol and the like; ethers such as dioxiane, furfural, ethyleneglycoldimethylether, methylcellosolve, ethylcellosolve, butylcellosolve, ethylcarbitol, buthylcarbito, buthylcarbitolacetate, epichlorohydrin and the like; ketones such as acetone, ethyl methyl ketone, 2-methyl-4-pentanone, acetophenone and the like; aliphatic acids such as formic acid, acetic acid, dichloroacetate, trichloroacetate and the like; esters such as methyl formate, ethyl formate, methyl acetate, ethyl acetate, n-butyl acetate, isobutyl acetate, 3-methoxybutyl acetate, n-pentyl acetate, ethyl propionate, ethyl lactate, methyl benzonate, diethyl malonate, dimethyl phthalate, diethyl phthalate, diethyl carbonate, ethylene carbonate, propylene carbonate, cellosolve acetate, butylcarbitol acetate, ethyl acetoacetate, methyl cyanoacetate, ethyl cyanoacetate and the like; nitrogen-containing compounds such as nitromethane, nitrobenzene, acetonitrile, propionitrile, succinonitrile, valeronitrile, benzonitrile, ethyl amine, diethyl amine, ethylenediamine, aniline, N-methylaniline, N,N-dimethylaniline, o-toluidine, p-toluidine, piperidine, pyridine, α-picoline, 2,6-lutidine, quinoline, propylene diamine, formamide, N-methylformamide, N,N-dimethylformamide, N,N-diethylformamide, acetamide, N-methylacetamide, N-methylpropionamide, N,N,N',N'-tetramethylurea, N-methylpyrrolidone and the like; sulfur-containing compounds such as dimethyl sulfoxide, sulfolane and the like; hydro carbons such as benzene, p-cymene, naphthalene, cyclohexylbenzene, cyclohexyene and the like; halogenated hydrocarbons such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene(cis-), tetrachloroethylene, 2-chlorobutan, 1-chloro-2-methylpropane, 2-chloro-2-methylpropane, bromomethane, tribromomethane, 1-promopropane and the like can be cited. Further, two or more types of each of the mentioned liquids may be mixed to be used as the liquid solution.

Further, conductive paste which includes large portion of material having high electric conductivity (silver pigment or the like) is used, and in the case of performing the jetting, as objective material for being dissolved into or dispersed into the above-mentioned liquid, excluding coarse particles causing clogging to the nozzles, it is not in particular limited. As fluorescent material such as PDP, CRT, FED or the like, what is conventionally known can be used without any specific limitation. For example, as red fluorescent material, (Y,Gd)$BO_3$:Eu, $YO_3$:Eu and the like, as red fluorescent material, $Zn_2SiO_4$:Mn, $BaAl_{12}O_{19}$:Mn, (Ba,Sr,Mg)O.α-$Al_2O_3$:Mn and the like, blue fluorescent material, $BaMgAl_{14}O_{23}$:Eu, $BaMgAl_{10}O_{17}$:Eu and the like can be cited. In order to make the above-mentioned objective material adhere on a recording medium firmly, it is preferably to add various types of binders. As a binder to be used, for example, cellulose and its derivative such as ethyl cellulose, methyl cellulose, nitrocellulose, cellulose acetate, hydroxyethyl cellulose and the like; alkyd resin; (metha)acrylate resin and its metal salt such as polymethacrytacrylate, polymethylmethacrylate, 2-ethylhexylmethacrylate methacrylic acid copolymer, lauryl methacrylate•2-hydroxyethylmethacrylate copolymer and the like; poly(metha)acrylamide resin such as poly-N-isopropylacrylamide, poly-N,N-dimethylacrylamide and the like; styrene resins such as polystyrene, acrylonitrile•styrene copolymer, styrene.maleate copolymer, styrene•isoprene copolymer and the like; various saturated or unsaturated polyester resins; polyolefin resins such as polypropylene and the like; halogenated polymers such as polyvinyl chloride, polyvinylidene chloride and the like; vinyl resins such as poly vinyl acetate, chloroethene•polyvinyl acetate copolymer and the like; polycarbonate resin; epoxy resins; polyurethane resins; polyacetal resins such as polyvinyl formal, polyvinyl butyral, polyvinyl acetal and the like; polyethylene resins such as ethylene•vinyl acetate copolymer, ethylene•ethyl acrylate copolymer resin and the like; amide resins such as benzoguanamine and the like; urea resin; melamine resin; polyvinyl alcohol resin and its anion cation degeneration; polyvinyl pyrrolidone and its copolymer; alkylene oxide homopolymer, copolymer and cross-linkage such as polyethelene oxide, polyethelene oxide carboxylate and the like; polyalkylene glycol such as polyethylene glycol, polypropylene glycol and the like; poryether polyol; SBR, NBR latex; dextrin; sodium alginate; natural or semi-synthetic resins such as gelatin and its derivative, casein, Hibiscus manihot, gum traganth, pullulan, gum arabic, locust bean gum, guar gum, pectin, carrageenan, glue, albumin, various types of starches, corn starch, arum root, funori, agar, soybean protein and the like; terpene resin; ketone resin; rosin and rosin ester; polyvinylmethylether, polyethyleneimine, polystyrene sulfonate, polyvinyl sulfonate and the like can be used. These resins may not only be used as homopolymer but be blended within a mutually soluble range to be used.

When the liquid jetting apparatus 20 is used as a patterning method, as a representative example, it is possible to use it for display use. Concretely, it is possible to cite formation of fluorescent material of plasma display, formation of rib of plasma display, formation of electrode of plasma display, formation of fluorescent material of CRT, formation of fluorescent material of FED (Field Emission type Display), formation of rib of FED, color filter for liquid crystal display (RGB coloring layer, black matrix layer), spacer for liquid crystal display (pattern corresponding to black matrix, dot pattern and the like). The rib mentioned here means a barrier in general, and with plasma display taken as an example, it is used for separating plasma areas of each color. For other uses, it is possible to apply it to microlens, patterning coating of magnetic material, ferrodielectric substance, conductive paste (wire, antenna) and the like for semiconductor use, as graphic use, normal printing, printing to special medium (film, fabric, steel plate), curved surface printing, lithographic plate of various printing plates, for processing use, coating of adhesive, sealer and the like using the present embodiment, for biotechnological, medical use, pharmaceuticals (such as one mixing a plurality of small amount of components), coating of sample for gene diagnosis or the like.

(Nozzle)

The above nozzle 21 is integrally formed with a nozzle plate 26*c* to be described later, and is provided to stand up perpendicularly with respect to a flat plate surface of the nozzle plate 26*c*. Further, at the time of jetting a droplet, the nozzle 21 is used to perpendicularly face a receiving surface (surface where the droplet lands) of the base material K. Further, in the nozzle 21, the in-nozzle passage 22 penetrating from its edge portion along the nozzle center is formed.

The nozzle 21 will be described in more detail. In the nozzle 21, an opening diameter of its edge portion and the in-nozzle passage 22 are uniform, and as mentioned, these are formed as a super minute diameter. As one concrete example of dimensions of each part, an inside diameter of the in-nozzle passage 22 is preferably not more than 30 [μm], more preferably less than 20 [μm], even more preferably not more than 10 [μm], even more preferably not more than 8 [μm], and even more preferably not more than 4 [μm], and in this embodiment, the inside diameter of the in-nozzle passage 22 is set to 1 [μm]. An outside diameter of the edge portion of the nozzle 21 is set to 2 [μm], a diameter of the root of the nozzle 21 is 5 [μm], and a height of the nozzle 21 is set to 100 [μm], and its shape is formed as a truncated conic shape being unlimitedly close to a conic shape. The inside diameter of the nozzle is preferably more than 0.2 [μm]. The height of the nozzle 21 may be 0 [μm].

Figure 18A:
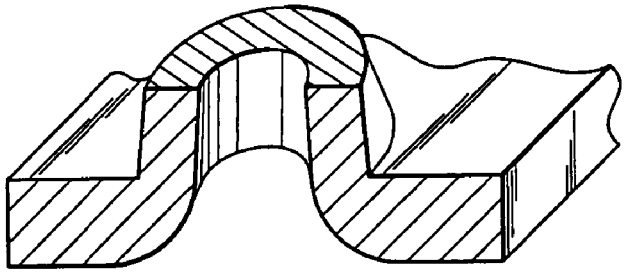
FIG. 18A is a partially broken perspective view showing an example of a shape of an in-nozzle passage providing roundness at a liquid solution room side.
Figure 18B:
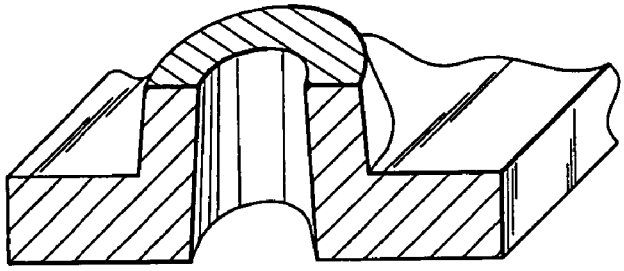
FIG. 18B is a partially broken perspective view showing an example of a shape of the in-nozzle passage having an inside surface thereof as a tapered circumferential surface.
Figure 18C:
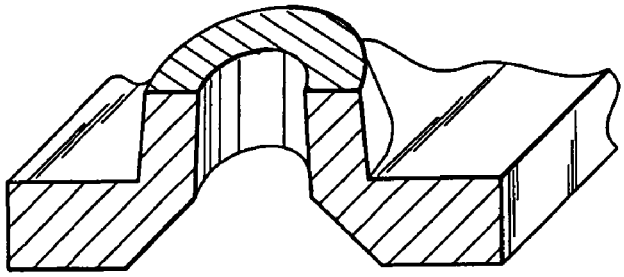
FIG. 18C is a partially broken perspective view showing an example of a shape of the in-nozzle passage combining the tapered circumferential surface and a linear passage.

In addition, a shape of the in-nozzle passage 22 may not be formed linearly with the inside diameter constant as shown in FIG. 11. For example, as shown in FIG. 18A, it may be so formed as to give roundness to a cross-section shape at the edge portion of the side of a liquid solution room 24 to be described later, of the in-nozzle passage 22. Further, as shown in FIG. 18B, an inside diameter at the end portion of the side of the liquid solution room 24 to be described later, of the in-nozzle passage 22 may be set to be larger than an inside diameter of the end portion at the jetting side, and an inside surface of the in-nozzle passage 22 may be formed in a tapered circumferential surface shape. Further, as shown in FIG. 18C, only the end portion of the side at the liquid solution room 24 to be describe later, of the in-nozzle passage 22 may be formed in a tapered circumferential surface shape and the jetting end portion side with respect to the tapered circumferential surface may be formed linearly with the inside diameter constant.

(Liquid Solution Supplying Section)

The liquid solution supplying section 29 is provided at a position being inside of the liquid jetting head 26 and at the root of the nozzle 21, and comprises the liquid solution room 24 communicated to the in-nozzle passage 22, a supplying passage 27 for guiding the liquid solution from an external liquid solution tank which is not shown, to the liquid solution room 24, and a not shown supplying pump for giving a supplying pressure of the liquid solution to the liquid solution room 24.

The above-mentioned supplying pump supplies the liquid solution to the edge portion of the nozzle 21, and supplies the liquid solution while maintaining the supplying pressure within a not-dripping range (refer to FIG. 12A).

The supplying pump includes the case of using a pressure difference according to arrangement positions of the liquid jetting head and the supplying tank, and may be formed only with a liquid supplying passage without separately providing the liquid solution section. Although it depends upon the design of the pump system, basically, the supplying pump operates when supplying the liquid solution to the liquid jetting head at the start time, jetting the liquid from the liquid jetting head 56, and supplying of the liquid solution according thereto is performed while optimizing capacity change in the liquid jetting head by a capillary and the convex meniscus forming section and each pressure of the supplying pumps.

(Jetting Voltage Applying Section)

The jetting voltage applying section 25 comprises a jetting electrode 28 for applying a jetting voltage, the jetting electrode 28 being provided inside the liquid jetting head 26 and at a border position between the liquid solution room 24 and the in-nozzle passage 22, and a direct current power source 30 for always applying a direct current jetting voltage to this jetting electrode 28.

The above-mentioned jetting electrode 28 directly contacts the liquid solution in the liquid solution room 24, for charging the liquid solution and applying the jetting voltage.

In regard to the jetting voltage by the direct current power source 30, the direct current power source 30 is controlled by the operation control section 50 so that a voltage value is in the range that a droplet can first be jetted in a state where convex meniscus by the liquid solution has already been formed at the edge portion of the nozzle 21, and a droplet can not be jetted in a state where the convex meniscus has not been formed.

The jetting voltage applied by the direct current power source 30 is theoretically calculated by the following equation (1).

$$h\sqrt{\frac{\gamma\pi}{\varepsilon_0 d}} > V > \sqrt{\frac{\gamma k d}{2\varepsilon_0}} \tag{1}$$

where, γ: surface tension of liquid solution [N/m], $\epsilon_0$: electric constant [F/m], d: nozzle diameter. [m], h: distance between nozzle and base material [m], k: proportionality constant dependent on nozzle shape (1.5<k<8.5).

The above conditions are theoretical values, thus, practically, experiments may be performed at the time when the convex meniscus is formed and not formed to calculate appropriate voltage values.

In the embodiment, the jetting voltage is set to 400[V] as an example.

(Liquid Jetting Head)

The liquid jetting head 26 comprises a flexible base layer 26*a* which is made of material with flexibility (for example, metal, silicon, resin or the like) and is placed at the lowest layer in FIG. 11, an insulating layer 26*d* which is made of insulating material and is formed on the entire upper surface of the flexible base layer 26*a*, a passage layer 26*b* which is placed on top thereof and forms a supplying passage of the liquid solution, and a nozzle plate 26*c* formed further on top of this passage layer 26*b*. The above-mentioned jetting electrode 28 is inserted between the passage layer 26*b* and the nozzle plate 26*c*.

The flexible base layer 26*a* may be, as described above, formed from material with flexibility, and a metal thin plate may be used as one example. Flexibility is required because the flexible base layer 26*a* is deformed when a piezo element 41 of the convex meniscus forming section 40 to be described later is provided at the position on the outer surface of the flexible base layer 26*a* corresponding to the liquid solution room 24. That is, by applying a predetermined voltage to the piezo element 41 and making the flexible base layer 26*a* dent in either inside or outside at the above position, internal capacity of the liquid solution room 24 is decreased or increased, thereby, according to a change of the internal pressure, it is possible to form the convex meniscus of the liquid solution at the edge portion of the nozzle 21 or draw the liquid level to the inside.

A resin film with high insulating properties is formed on the upper surface of the flexible base layer 26*a* to form an insulating layer 26*d*. The insulating layer 26*d* is formed thin enough not to prevent the flexible base layer 26*a* from denting, or is made of resin material which is deformed more easily.

A soluble resin layer is formed on the insulating layer 26*d*, which is eliminated only leaving a portion corresponding to the predetermined pattern for forming the supplying passage 27 and the liquid solution room 24, and an insulating resin layer is formed on a portion from which the resin layer is eliminated excluding the remaining portion. This insulating resin layer functions as the passage layer 26*b*. Then, the jetting electrode 28 is flatly formed on an upper surface of this insulating resin layer with plating of a conductive element (for example NiP), and a resist resin layer or parylene layer having insulating properties is formed further on top thereof. Since this resist resin layer becomes the nozzle plate 26*c*, this resin layer is formed with thickness in consideration of a height of the nozzle 21. Then, this insulating resist resin layer is exposed by an electron beam method or femtosecond laser, for forming a nozzle shape. The in-nozzle passage 22 is also formed by a laser processing. Then, the soluble resin layer corresponding to the pattern of the supplying passage 27 and the liquid solution room 24 is eliminated, these supplying passage 27 and the liquid solution room 24 are communicated, and the production of the liquid jetting head 26 is completed.

In addition, material of the nozzle plate 26*c* and the nozzle 21 may be, concretely, semiconductor such as Si or the like, conductive material such as Ni, SUS or the like, other than insulating material such as epoxy, PMMA, phenol, soda glass. However, in a case of forming the nozzle plate 26*c* and the nozzle 21 from conductive material, at least at the edge portion edge surface of the edge portion of the nozzle 21, more preferably at the circumferential surface of the edge portion, coating by insulating material is preferably provided. This is because, by forming the nozzle 21 from insulating material or forming the insulating material coating at its edge portion surface, at the time of applying the jetting voltage to the liquid solution, it is possible to effectively suppress leakage of electric current from the nozzle edge portion to the counter electrode 23.

(Counter Electrode)

The counter electrode 23 comprises a facing surface perpendicular to a protruding direction of the nozzle 21, and supports the base material K along the facing surface. A distance from the edge portion of the nozzle 21 to the facing surface of the counter electrode 23 is, as one example, set to 100 [μm], preferably not more than 500 [μm], and more preferably not more than 100 [μm].

Further, since this counter electrode 23 is grounded, the counter electrode 23 always maintains grounded potential. Therefore, a droplet jetted by an electrostatic force by electric field generated between the edge portion of the nozzle 21 and the facing surface is guided to a side of the counter electrode 23.

In addition, since the liquid jetting apparatus 20 jets a droplet by enhancing the electric field intensity by the electric field concentration at the edge portion of the nozzle 21 according to super-miniaturization of the nozzle 21, it is possible to jet the droplet without the guiding by the counter electrode 23. However, the guiding by an electrostatic force between the nozzle 21 and the counter electrode 23 is preferably performed. Further, it is possible to let out the electric charge of a charged droplet by grounding the counter electrode 23.

(Convex Meniscus Forming Section)

The convex meniscus section 40 comprises the piezo element 41 as a piezoelectric element arranged on the position corresponding to the liquid solution room 24 at the outer side surface of the flexible base layer 26*a* of the nozzle plate 26 (lower surface in FIG. 11), and a driving voltage power source 42 for applying a driving pulse voltage for changing a shape of this piezo element 41.

The above piezo element 41 is attached to the flexible base layer 26*a* so that the flexible base layer 26*a* is deformed in a direction to dent in any of the inside or outside.

The driving voltage power source 42 outputs the driving pulse voltage (for example, 10 [V]) corresponding to a first voltage value appropriate for the piezo element 41 to appropriately reduce the capacity of the liquid solution room 24 to transfer to the state where the liquid solution in the in-nozzle passage 22 forms the convex meniscus at the edge portion of the nozzle 21 (refer to FIG. 12B) from the state where a concave meniscus is formed (refer to FIG. 12A) by the control of the operation control section 50. Further, the driving voltage power source 42 outputs the driving pulse voltage corresponding to a second voltage value appropriate for the piezo element 41 to appropriately increase the capacity of the liquid solution room 24 to transfer from the state where the liquid solution in the in-nozzle passage 22 forms the concave meniscus at the edge portion of the nozzle 21 (refer to FIG. 12A) to the state where the liquid level is drawn into a predetermined distance (refer to FIG. 12C) by the control of the operation control section 50. The driving pulse voltage of the second voltage value needs to deform the piezo element 41 in a direction opposite to the deforming direction of the piezo element 41 by applying the driving pulse voltage of the first voltage value, so that the second voltage value has a reverse polarity of the first voltage value. The drawing distance of the liquid level is not specially limited, however, it may be a degree that the liquid level stops at a position in the middle of the in-nozzle passage 22.

As another driving pattern, the first voltage value has been always applied in the state where the concave meniscus of the liquid solution is formed at the edge portion of the nozzle 21 in the in-nozzle passage 22 (refer to FIG. 12A), and the liquid solution 24 is in the reduced state. Next, for transferring to the state to form the convex meniscus (refer to FIG. 12B), further, the driving pulse voltage corresponding to the second voltage value appropriate for the piezo element 41 to appropriately reduce the liquid solution in the liquid solution room 24 is output. The driving voltage power source 42 can set a voltage to 0 [V] for the piezo element 41 to appropriately increase the capacity of the liquid solution room 24 to transfer from the state where the liquid solution in the in-nozzle passage 22 forms the concave meniscus at the edge portion of the nozzle 21 (refer to FIG. 12A) to the state where the liquid level is drawn into a predetermined distance (refer to FIG. 12C) by the control of the operation control section 50.

(Operation Control Section)

The operation control section 50 is in practice structured from a calculation device including a CPU, a ROM, a RAM and the like, to which a predetermined program is input to thereby realize the following functional structure and perform the following operation control.

The above operation control section 50 makes the direct current power source 30 apply the jetting voltage continuously, and comprises a first jetting control unit 51 for controlling the application of the driving pulse voltage of the first voltage value by the driving voltage power source 42 when receiving the input of a jetting instruction from outside, and a liquid level stabilization control unit 52 for performing an operation control to make the driving pulse voltage of the second voltage value applied by the driving voltage power source 42 after the application of the driving pulse voltage of the first voltage value.

The operation control section 50 comprises a not shown receiving section to receive the jetting instruction signal from outside.

The first jetting control unit 51 makes the direct current power source 30 apply the jetting voltage to be always constant to the jetting electrode 28. Further, the first jetting control unit 51 recognizes the reception of the jetting instruction signal through the receiving section to make the driving voltage power source 42 apply the driving pulse voltage of the first voltage value to the piezo element 41. Thereby, jetting a droplet from the edge portion of the nozzle 21 is performed.

The liquid level stabilization control unit 52 recognizes the output of the driving pulse voltage of the first voltage value of the driving voltage power source 42 by the first jetting control unit 51, and immediately thereafter, makes the driving voltage power source 42 apply the driving pulse voltage of the second voltage value to the piezo element 41.

(Jetting Operation of Minute Droplet by Liquid Jetting)

An operation of the liquid jetting apparatus 20 will be described with reference to FIG. 11 to FIG. 12C.

The state is such that the liquid solution has been supplied to the in-nozzle passage 22 by the supplying pump of the liquid solution supplying section, and in this state, the jetting voltage is applied to be always constant to the jetting electrode 28 from the direct current power source 30 (FIG. 12A). In this state, the liquid solution is in a charged state.

Then, when a jetting instruction signal is input to the operation control section 50 from outside, according to the control of the first jetting control unit 51, the driving pulse voltage of the first voltage value by the driving voltage power source 42 is applied to the piezo element 41. Thereby, the electric field intensity is made high due to the electric field concentration state by the charged liquid solution and convex meniscus forming state at the edge portion of the nozzle 21, and a minute droplet is jetted at the top of the convex meniscus (FIG. 12B).

After jetting the droplet, although the convex meniscus becomes a vibration state, the driving pulse voltage of the second voltage value by the driving voltage power source 42 is applied to the piezo element 41 by the liquid level stabilization control unit 52 immediately, so that the convex meniscus disappears, and the liquid level of the liquid solution is drawn to the inside of the nozzle 21 (FIG. 12C). The disappearance of the convex meniscus and the movement of the liquid solution in the nozzle 21 of low conductance due to the minute diameter stop the vibration state. The drawn state of the liquid level at the edge portion of the nozzle 21 is temporary because of the pulse voltage, and can back to the state of FIG. 12A.

As described above, a constant voltage is always applied to the liquid solution by the first jetting control unit 51 irrespective of performing or not performing the jetting, so that improvement of responsiveness at jetting and stabilization of liquid volume can be achieved.

The liquid level stabilization control unit can suppress vibration by the convex meniscus forming section just after jetting by sucking, so that next jetting can be performed without waiting a lapse of waiting time for the convex meniscus to stop the vibration, enabling to easily deal with continuous jetting operations.

Further, since the above-mentioned liquid jetting apparatus 20 jets a droplet by the nozzle 21 having minute diameter which cannot be found conventionally, the electric field is concentrated by the liquid solution in a charged state in the in-nozzle passage 22, and thereby the electric field intensity is enhanced. Therefore, jetting of the liquid solution by a nozzle having a minute diameter (for example, an inside diameter of 100 [μm]), which was conventionally regarded as substantially impossible since a voltage necessary for jetting would become too high with a nozzle having a structure in which concentration of the electric field is not performed, is now possible with a lower voltage than the conventional one.

Since liquid solution flow at the in-nozzle passage 22 is restricted because of low conductance due to the minute nozzle diameter, it is possible to do the control to easily reduce jetting quantity per unit time, and the jetting of the liquid solution with a sufficiently-small droplet diameter (0.8 [μm] according to each above-mentioned condition) without narrowing a pulse width is realized.

Further, since the jetted droplet is charged, even though it is a minute droplet, a vapor pressure is reduced and evaporation is suppressed, and thereby the loss of mass of the droplet is reduced, the flying stabilization is achieved and the decrease of landing accuracy of the droplet is prevented.

In addition, for obtaining electro wetting effect to the nozzle 21, an electrode may be provided at a circumference of the nozzle 21, or an electrode may be provided at an inside surface of the in-nozzle passage 22 and an insulating film may cover over it. Then, by applying a voltage to this electrode, it is possible to enhance wettability of the inside surface of the in-nozzle passage 22 with respect to the liquid solution to which the voltage is applied by the jetting electrode 28 according to the electro wetting effect, and thereby it is possible to smoothly supply the liquid solution to the in-nozzle passage 22, resulting in preferably performing the jetting and improving responsiveness of the jetting.

Further, the jetting voltage applying section 25 always applies the bias voltage and jets a droplet by using the pulse voltage as a trigger. However, it may be possible to have a structure where jetting is performed by always applying alternate current with amplitude necessary for jetting or continuous rectangular wave and by changing high and low of its frequency. It is essential to have the liquid solution charged for jetting a droplet, and when the jetting voltage is applied at a frequency exceeding a speed at which the liquid solution is charged, the jetting is not performed, but the jetting is performed when it is switched to a frequency at which it is possible to charge the liquid solution sufficiently. Therefore, by doing the control to apply the jetting voltage with a frequency larger than a frequency at which it is possible to jet when jetting is not performed, and to reduce the frequency to a frequency band where it is possible to perform the jetting only when the jetting is to be performed, it is possible to control the jetting of the liquid solution. In such a case, since an electric potential to be applied to the liquid solution does not have a change in itself, it is possible to improve time responsiveness even more, and thereby it is possible to improve landing accuracy of a droplet.

Second Embodiment

Figure 13:
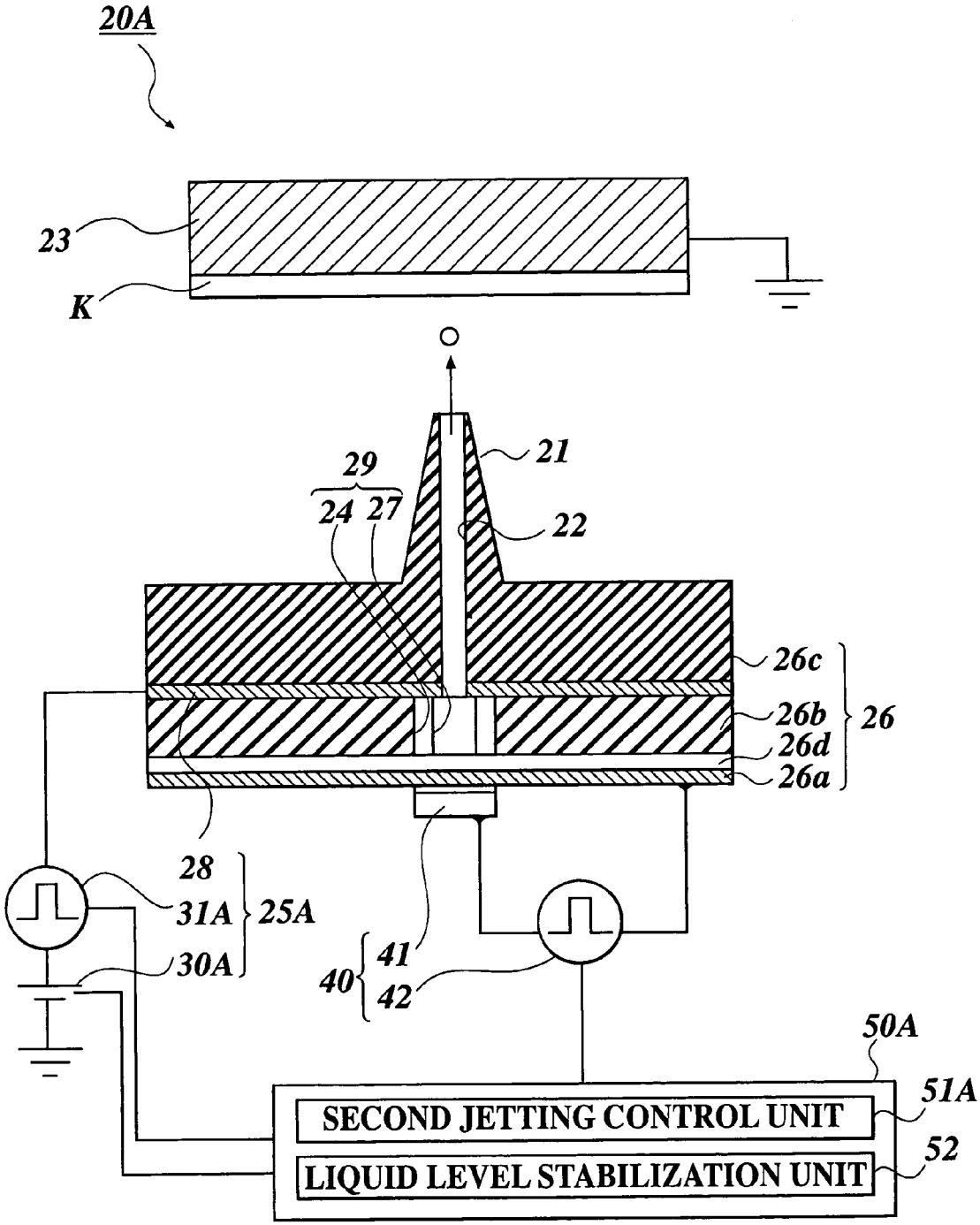
FIG. 13 is a sectional view along the nozzle of the liquid jetting apparatus in the second embodiment.
Figure 14A:
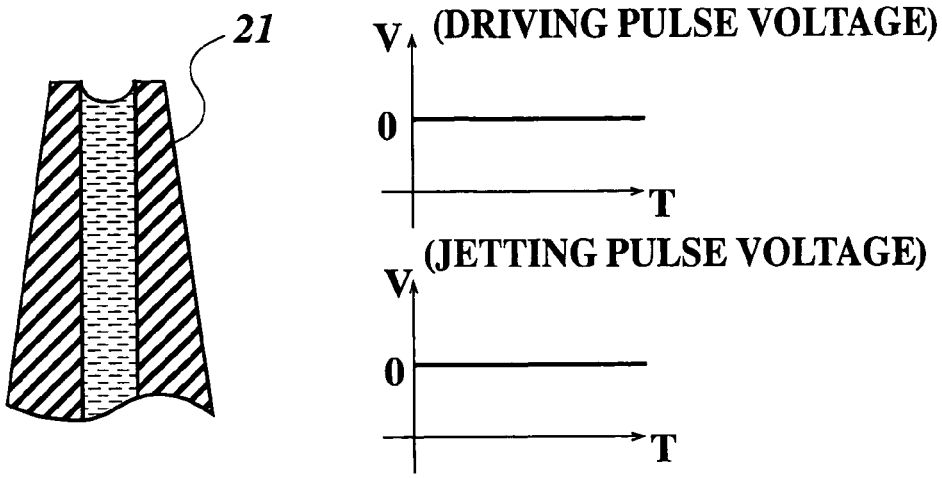
FIG. 14A is an explanation view of a relation between the jetting operation of liquid solution and a voltage applied to the liquid solution in a state where the jetting is not performed.
Figure 14B:
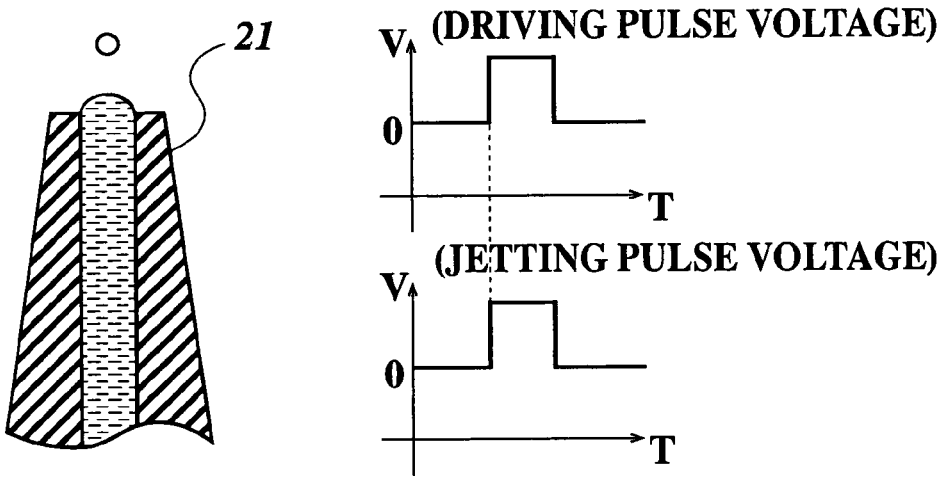
FIG. 14B is an explanation view of a relation between the jetting operation of the liquid solution and the voltage applied to the liquid solution in the jetting state.
Figure 14C:
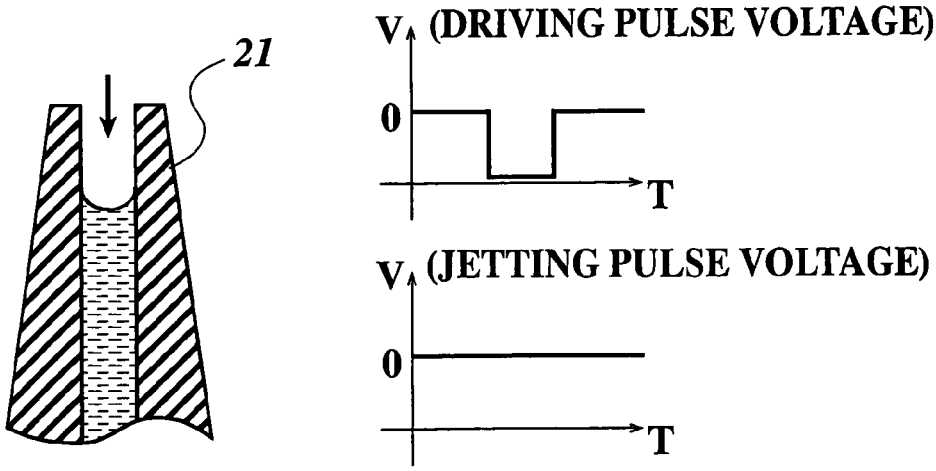
FIG. 14C is an explanation view of a relation between the jetting operation of the liquid solution and the voltage applied to the liquid solution after the jetting.

Next, a liquid jetting apparatus 20A as the second embodiment of the present invention will be explained based on FIG. 13 to FIG. 14C. FIG. 13 is a sectional view of the liquid jetting apparatus 20A, and FIG. 14A, FIG. 14B, and FIG. 14C are explanation views of a relation between a jetting operation of liquid solution and a voltage applied to the liquid solution. FIG. 14A shows a state where the jetting is not performed, FIG. 14B shows a jetting state, and FIG. 14C shows a state after the jetting. In FIG. 13, for the convenience of a description, a state where the edge portion of the nozzle 21 faces upward is illustrated. However, practically, the apparatus is so used that the nozzle 21 faces in a horizontal direction or a lower direction than the horizontal direction, more preferably, the nozzle 21 faces perpendicularly downward.

In the explanation of the embodiment, the component that is same as that of the liquid jetting apparatus 20 in the first embodiment will be given the same reference numeral, thus the overlapping explanations are omitted here.

(Whole Structure of Liquid Jetting Apparatus)

The features of the liquid jetting apparatus 20A in comparison to the above described liquid jetting apparatus 20 are a jetting voltage applying section 25A for applying a jetting voltage to the liquid solution in the nozzle 21, and an operation control section 50A for controlling applying a driving voltage of the convex meniscus forming section 40 and the jetting voltage by the jetting voltage applying section 25A. Thus, only the explanations thereof will be made.

(Jetting Voltage Applying Section)

The jetting voltage applying section 25A comprises the above described jetting electrode 28 for applying the jetting voltage, a bias power source 30A for always applying a direct current bias voltage to this jetting electrode 28, and a jetting voltage power source 31A for applying a jetting pulse voltage to the jetting electrode 28 with the bias voltage superimposed to be an electric potential for jetting.

In regard to the bias voltage by the bias power source 30A, by always applying a voltage within a range within which jetting of the liquid solution is not performed, width of a voltage to be applied at jetting is preliminarily reduced, herewith responsiveness at jetting is improved.

The jetting voltage power source 31A is controlled by the operation control section 50A so that a voltage value is in the range where a droplet can first be jetted in a state where convex meniscus by the liquid solution has already been formed at the edge portion of the nozzle 21, and a droplet can not be jetted in a state where the convex meniscus has not been formed, in the case of superimposing the bias voltage.

The jetting pulse voltage applied by the jetting voltage power source 31A is calculated by the above described equation (1) in a state of being superimposed on the bias voltage.

The above conditions are theoretical values, thus, practically, experiments may be performed at the time when the convex meniscus is formed and not formed to calculate appropriate voltage values. As one example, the bias voltage is applied at DC300 [V], and the jetting pulse voltage is applied at 100 [V]. Therefore, the superimposed voltage at jetting is 400 [V].

(Operation Control Section)

The operation control section 50A practically is structured by a calculation device including a CPU, a ROM, a RAM and the like, to which a predetermined program is input to thereby realize the following functional structure and perform the following operation control.

The above operation control section 50A comprises a second jetting control unit 51A for controlling the applications of the jetting pulse voltage by the jetting voltage power source 31A and the driving pulse voltage of the first voltage value by the driving voltage power source 42 in synchronization with each other when receiving the input of a jetting instruction from outside in a state of continuously making the bias power source 30A apply the bias voltage, and the liquid level stabilization control unit 52 for performing the operation control to make the driving voltage power source 42 apply the driving pulse voltage of the second voltage value after the application of the jetting pulse voltage and the driving pulse voltage of the first voltage value.

The operation control section 50A comprises a not shown receiving section to receive a jetting instruction signal from outside.

The second jetting control unit 51A makes the bias power source 30A apply the bias voltage to be always constant to the jetting electrode 28. Further, the second jetting control unit 51A recognizes reception of the jetting instruction signal via the receiving section to make the jetting voltage power source 31A apply the jetting pulse voltage and make the driving voltage power source 42 apply the driving pulse voltage of the first voltage value in synchronization with each other. Thereby, jetting of a droplet from the edge portion of the nozzle 21 is performed.

Here, the synchronization described above includes both cases of making the voltages applied exactly at the same time, and making the voltages applied approximately at the same time after considering responsiveness by charging speed of the liquid solution and responsiveness by pressure change by the piezo element 41 and adjusting the difference between them.

(Jetting Operation of Minute Droplet by Liquid Jetting Apparatus)

An operation of the liquid jetting apparatus 20A will be described with reference to FIG. 13 and FIG. 14C.

The state is such that the liquid solution has been supplied to the in-nozzle passage 22 by the supplying pump of a liquid solution supplying section, and in this state, the bias voltage is applied to be always constant to the jetting electrode 28 from the bias power source 30A (FIG. 14A).

Then, when a jetting instruction signal is input to the operation control section 50A from outside, according to the control of the second jetting control unit 51A, application of the jetting pulse voltage to the jetting electrode 28 by the jetting voltage power source 31A and application of the driving pulse voltage of the first voltage value to the piezo element 41 by the driving voltage power source 42 are performed in synchronization with each other. Thereby, the electric field intensity are made high due to the electric field concentration state by the charged liquid solution and convex meniscus forming state by the edge portion of the nozzle 21, thereby jetting a minute droplet at the top of the convex meniscus (FIG. 14B).

After jetting the droplet, although the convex meniscus becomes a vibration state, the driving pulse voltage of the second voltage value by the driving voltage power source 42 is applied to the piezo element 41 by the liquid level stabilization control unit 52 immediately, so that the liquid level of the liquid solution is drawn to the inside of the nozzle 21 (FIG. 14C).

As described above, since the liquid jetting apparatus 20A has effects similar to that of the liquid jetting apparatus 20, and the application of the jetting pulse voltage to the jetting electrode 28 by the jetting voltage power source 31A and the application of the driving pulse voltage of the first voltage value to the piezo element 41 by the driving voltage power source 42 are performed in synchronization with each other by the second jetting control unit 51A, jetting responsiveness can be further improved in comparison to the case of applying them at different timings.

[Others]

In the above liquid jetting apparatuses 20, 20A, the piezo element 41 is utilized to form the convex meniscus at the edge portion of the nozzle 21, however, as the convex forming section, each section such as for guiding liquid solution to the edge portion side in the in-nozzle passage 22, flowing to the same direction, increasing the pressure and the like can also be used. For example, it is possible to form the convex meniscus by changing the capacity of the inside of the liquid solution room by an electrostatic actuator system in which a vibration plate provided in the liquid solution room is deformed, however, this is not shown in the drawing. Here, the electrostatic actuator is a mechanism in which a wall of a passage is deformed by an electrostatic force to change the capacity. In the case of using the electrostatic actuator, forming the convex meniscus is performed such that the electrostatic actuator changes the capacity in the liquid solution room by the shape change thereof to increase the nozzle pressure. Further, when drawing the liquid level at the nozzle edge portion to the inside, it is performed such that capacity of the liquid solution room is changed by the shape change of the electrostatic actuator, and the nozzle pressure is decreased. By forming the convex meniscus by changing the capacity with the use of the electrostatic actuator, although the structure may be complicated compared to the case of using a piezo element, similarly, there is no limitation to the liquid solution and it is possible to drive at high frequency. In addition, effects of arranging nozzles with high density and excellent environmental responsiveness can be obtained.

Figure 15:
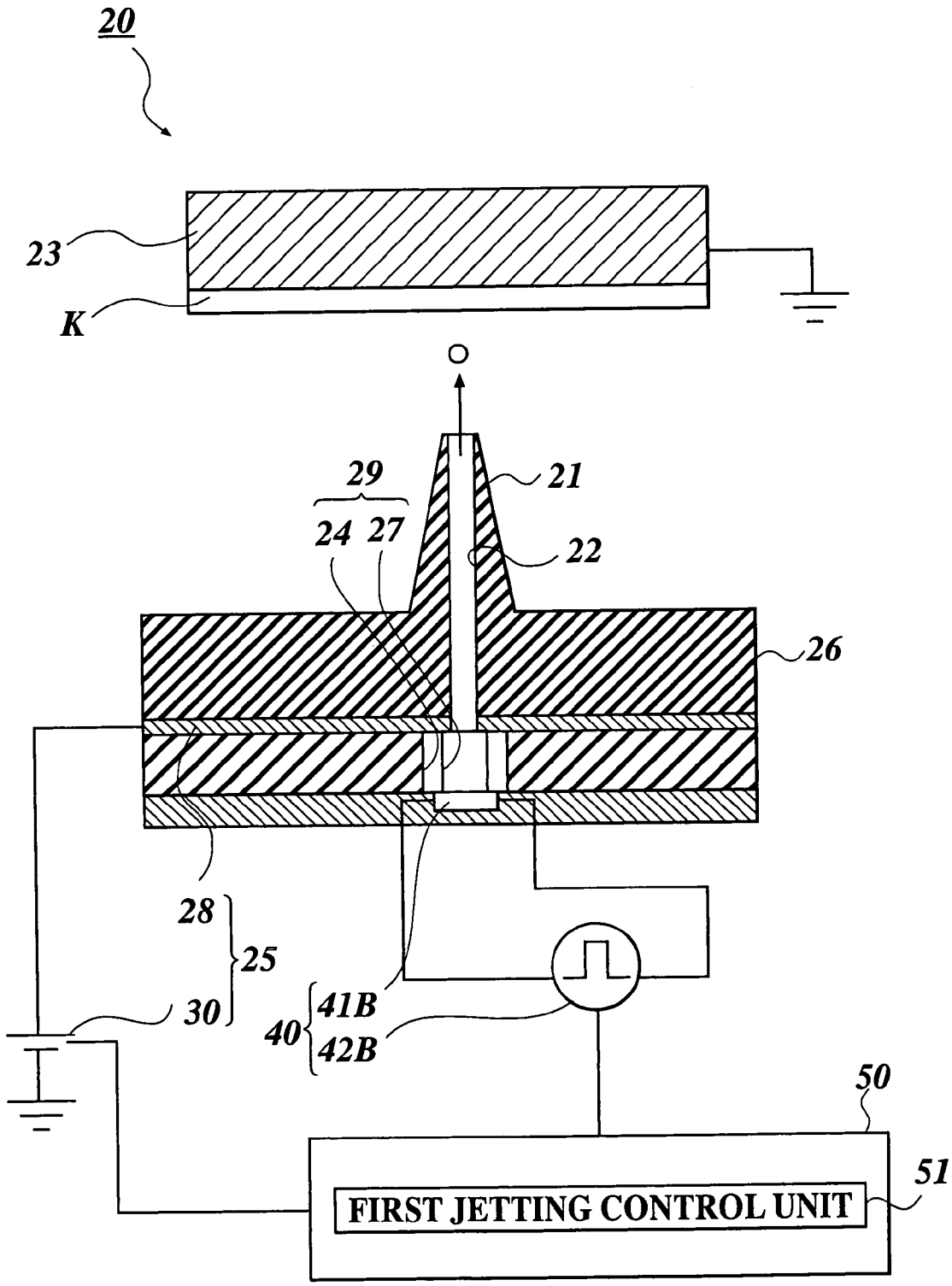
FIG. 15 is a sectional view along the nozzle showing an example in which a heater is adopted to the liquid jetting apparatus.

Further, as shown in FIG. 15, a heater 41B may be provided in the liquid solution room of the nozzle plate 26 or near the liquid solution room as a section to heat the liquid solution. This heater 41B rapidly heats the liquid solution and generates air bubbles by evaporation to increase the pressure in the liquid solution room 24, thereby forming the convex meniscus at the edge portion of the nozzle 21.

In this case, the lowermost layer of the nozzle plate 26 (a layer in which the heater 41B is embedded in FIG. 15) needs to have insulating properties, however, the structure is not needed to be flexible because a piezo element is not used. But, when the heater 41B is arranged to be exposed to the liquid solution in the liquid solution room 24, the heater 41B and the wiring thereof need to be insulated.

Figure 16A:
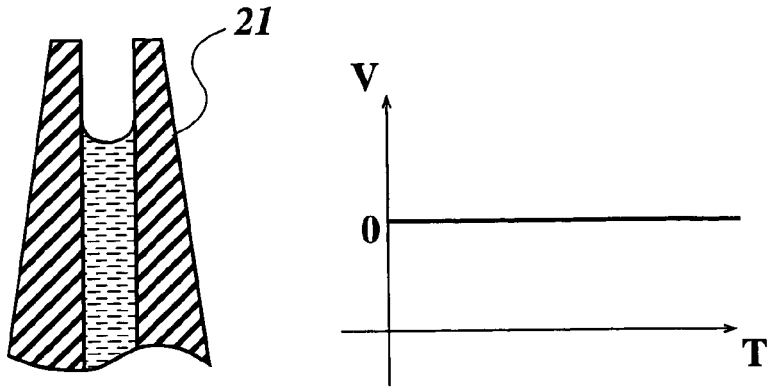
FIG. 16A is an explanation view of a relation between the jetting operation of the liquid solution and a voltage applied to the heater in a state where the jetting is not performed.
Figure 16B:
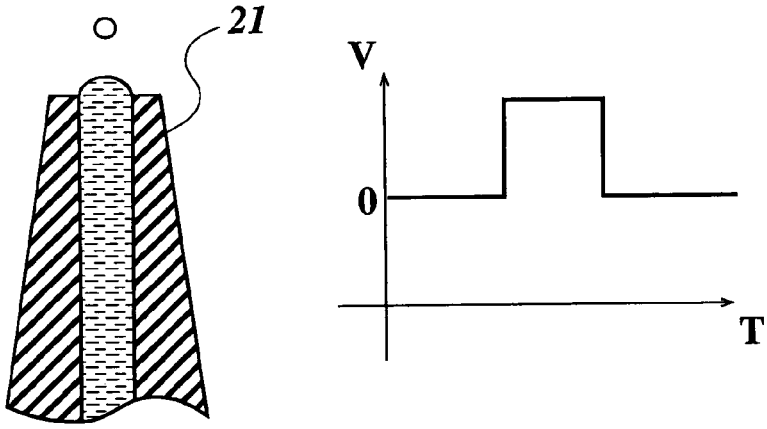
FIG. 16B is an explanation view of a relation between the jetting operation of the liquid solution and the voltage applied to the heater in the jetting state.
Figure 16C:
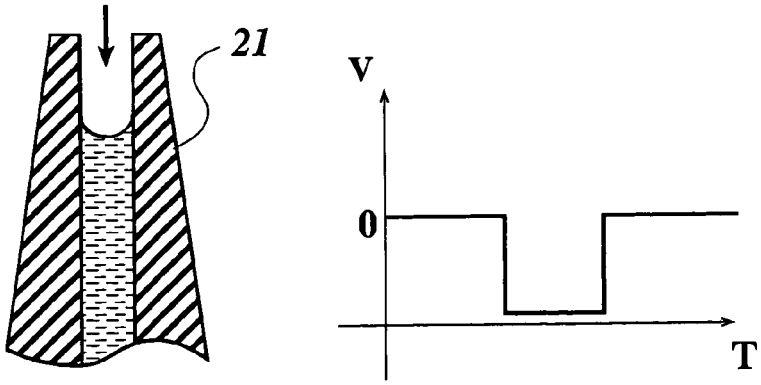
FIG. 16C is an explanation view of a relation between the jetting operation of the liquid solution and the voltage applied to the heater after the jetting.

In principle of the convex meniscus formation, the heater 41B cannot draw the liquid level of the liquid solution at the edge portion of the nozzle 21, so that the control by the liquid level stabilization control unit 52 cannot be performed. However, for example as shown in FIG. 16C, the meniscus standby position (the liquid level position of the liquid solution at the edge portion of the nozzle 21 when the heater 41B does not perform heating) is lowered, so that the effect of stabilizing the meniscus just after jetting can be similarly obtained.

The heater 41B with high heat responsiveness is used, and a driving voltage power source 42B for applying a heating pulse voltage (for example, 10 [V]) to the heater 41B is used to drive it.

Figure 17A:
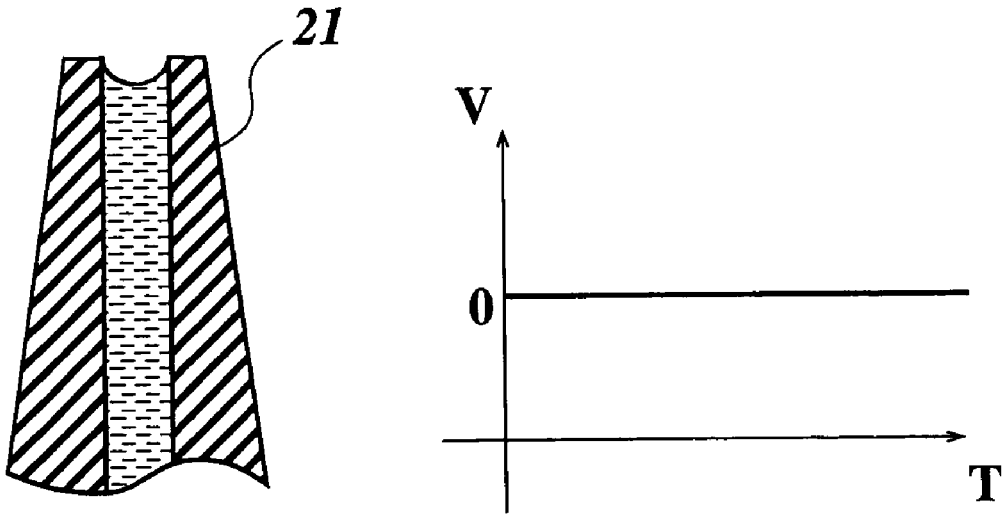
FIG. 17A is an explanation view of a relation between the jetting operation of the liquid solution and the voltage applied to the liquid solution in a state where the jetting is not performed.

Further, explaining the operation in the case of adopting the heater 41B to the liquid jetting apparatus 20, the liquid solution is supplied to the in-nozzle passage 22, and the jetting voltage is applied to be always constant to the jetting electrode 28 from the direct current power source 30. In this state, the liquid solution is in a charged state. The heater 41B is not in a heating state, so that the liquid level at the edge portion of the nozzle 21 is at the meniscus standby position (FIG. 17A).

Figure 17B:
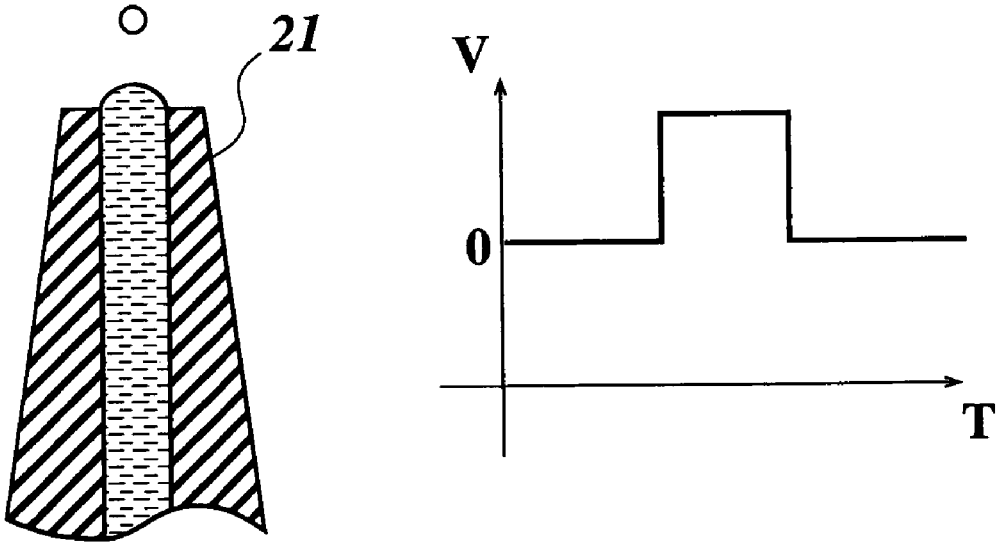
FIG. 17B is an explanation view of a relation between the jetting operation of the liquid solution and the voltage applied to the liquid solution in the jetting state.

Then, when a jetting instruction signal is input to the operation control section 50 from outside, according to the first jetting control unit 51, the heating pulse voltage by the driving voltage power source 42B is applied to the heater 41B. Thereby, air bubbles are generated in the liquid solution room 24 and the internal pressure thereof temporarily increases, so that the convex meniscus is formed at the edge portion of the nozzle 21. Meanwhile, since the liquid solution has already been applied with the jetting voltage to be in the charged state, the formation of the convex meniscus functions as a trigger to jet a minute droplet from the top thereof (FIG. 17B).

After jetting the droplet, although the convex meniscus becomes in a vibration state, the heater 41B is not in a heating state, thus, the liquid level at the edge portion of the nozzle 21 returns to the meniscus standby position. Thus, the convex meniscus disappears and the liquid level of the liquid solution is drawn to the inside of the nozzle 21.

As described above, when the convex meniscus forming section has a structure of adopting the heater 41B, the applying voltage to the liquid solution does not change, so that improvement of responsiveness at jetting and stabilization of liquid volume can be achieved. Further, jetting of the liquid solution can be performed with responsiveness according to heat responsiveness of the heater 41B, thereby improving responsiveness of the jetting operation.

Since the structure in which the liquid solution room 24 is flexible like the case of using a piezo element is not needed, productivity can be improved due to the simplified structure.

The above heater 41B may be adopted to the liquid jetting apparatus 20A. In this case, when a jetting instruction signal is input from outside by the second jetting control unit 51A of the operation control section 50A in a state of continuously applying the bias voltage by the bias power source 30A, the applications of the jetting pulse voltage by the jetting voltage power source 31A and the heating pulse voltage by the driving voltage power source 42B are performed in synchronization with each other by the second jetting control unit 51A of the operation control section 50A.

In this case, also the applications of the jetting pulse voltage by the jetting voltage power source 31A to the jetting electrode 28 and the heating pulse voltage to the heater 41B by the driving voltage power source 42B are performed in synchronization with each other, so that jetting responsiveness can be improved in comparison to the case of applying them at different timings.

[Comparative Study]

The results of the comparative study of various liquid jetting apparatuses comprising the above mentioned convex meniscus forming section and a liquid jetting apparatus with no convex meniscus forming section performed under the predetermined conditions are explained below. FIG. 19 is a chart showing comparative study results. The subjects for the comparative study are seven kinds shown in the following.

① Control Pattern A
Convex Meniscus Forming Section: Unavailable
Jetting Voltage Applying Section: Bias Voltage+Jetting Pulse Voltage
Synchronization: Unavailable
Liquid Level Sucking: Unavailable ② Control Pattern B
Convex Meniscus Forming Section: Piezo Element
Jetting Voltage Applying Section: Direct Current Voltage
Synchronization: Unavailable
Liquid Level Sucking: Unavailable ③ Control Pattern C
Convex Meniscus Forming Section: Piezo Element
Jetting Voltage Applying Section: Bias Voltage+Jetting Pulse Voltage
Synchronization: Synchronizing Piezo Element with Jetting Pulse Voltage
Liquid Level Sucking: Unavailable ④ Control Pattern D
Convex Meniscus Forming Section: Piezo Element
Jetting Voltage Applying Section: Direct Current Voltage
Synchronization: Unavailable
Liquid Level Sucking: Available ⑤ Control Pattern E
Convex Meniscus Forming Section: Piezo Element
Jetting Voltage Applying Section: Bias Voltage+Jetting Pulse Voltage
Synchronization: Synchronizing Piezo Element with Jetting Pulse Voltage
Liquid Level Sucking: Available ⑥ Control Pattern F
Convex Meniscus Forming Section: Heater
Jetting Voltage Applying Section: Direct Current Voltage
Synchronization: Unavailable
Liquid Level Sucking: Unavailable ⑦ Control Pattern G
Convex Meniscus Forming Section: Heater
Jetting Voltage Applying Section: Bias Voltage+Jetting Pulse Voltage
Synchronization: Synchronizing Heater with Jetting Pulse Voltage
Liquid Level Sucking: Unavailable The structure other than the above described conditions is same as that in the liquid jetting apparatus 20 shown in the first embodiment. That is, the nozzle with the inside diameter of the in-nozzle passage and the jetting opening of 1 [μm] is used.

Further, as the driving conditions, frequency of the pulse voltage as a trigger for jetting: 1 [kHz], and the jetting voltage: (1) the direct current (400 [V]), (2) the bias voltage (300 [V])+the jetting pulse voltage (100 [V]), the piezo element driving voltage: 10 [V] and the heater driving voltage 10 [V].

The liquid solution is water, and properties thereof are such that a viscosity: 8 [cP] ($8\times10^{-2}$ [Pa/S]), a resistivity: $10^{8}$ [Ωcm] and a surface tension: $30\times10^{-3}$ [N/m].

The evaluation method is performed so that jetting is performed 20 times continuously with the above jetting frequency on the glass plate of 0.1 [mm]. The evaluation was performed on five scales, wherein five is the best result.

According to the results of the evaluation, the liquid jetting apparatus of ⑤ Control Pattern E (using the piezo element, applying the superimposed voltage of the bias voltage and the jetting pulse voltage by the jetting voltage applying section, synchronizing the piezo element with the jetting pulse voltage, and sucking the liquid level) shows the highest responsiveness. Incidentally, the control pattern E is the structure same as the liquid jetting apparatus 20A shown in the second embodiment.

[Theoretical Description of Liquid Jetting by Liquid Jetting Apparatus]

Hereinafter, a theoretical description of liquid jetting of the present invention and a description of a basic example based on this will be made. In addition, all the contents such as a nozzle structure, material of each part and properties of jetted liquid, a structure added around the nozzle, a control condition regarding a jetting operation and the like in the theory and the basic example described hereafter may be, needless to say, applied in each of the above-mentioned embodiments as much as possible.

(Approach to Realize Applying Voltage Decrease and Stable Jetting of Minute Droplet Amount)

Previously, jetting of a droplet with exceeding a range determined by the following conditional equation was considered impossible.

$$d < \frac{\lambda_c}{2} \tag{4}$$

where, $\lambda_c$ is growth wavelength [m] at liquid level of the liquid solution for making it possible to jet a droplet from the nozzle edge portion by an electrostatic sucking force, and it can be calculated by $\lambda_c=2\pi\gamma h^2/\epsilon_0 V^2$.

$$d < \frac{\pi\gamma h^2}{\varepsilon_0 V^2} \tag{5}$$

$$V < h\sqrt{\frac{\pi\gamma}{\varepsilon_0 d}} \tag{6}$$

In the present invention, a role in an electrostatic sucking type inkjet method played by the nozzle is reconsidered, in an area where attempt was not made since it was conventionally regarded as impossible to jet, it is possible to form a minute droplet by using a Maxwell force or the like.

An equation for approximately expressing a jetting condition or the like for the approach to reduce a driving voltage and to realize jetting of minute droplet amount in this way is derived and therefore described hereafter.

Descriptions hereafter can be applied to the liquid jetting apparatus described in each of the above-mentioned embodiments of the present invention.

Figure 20:
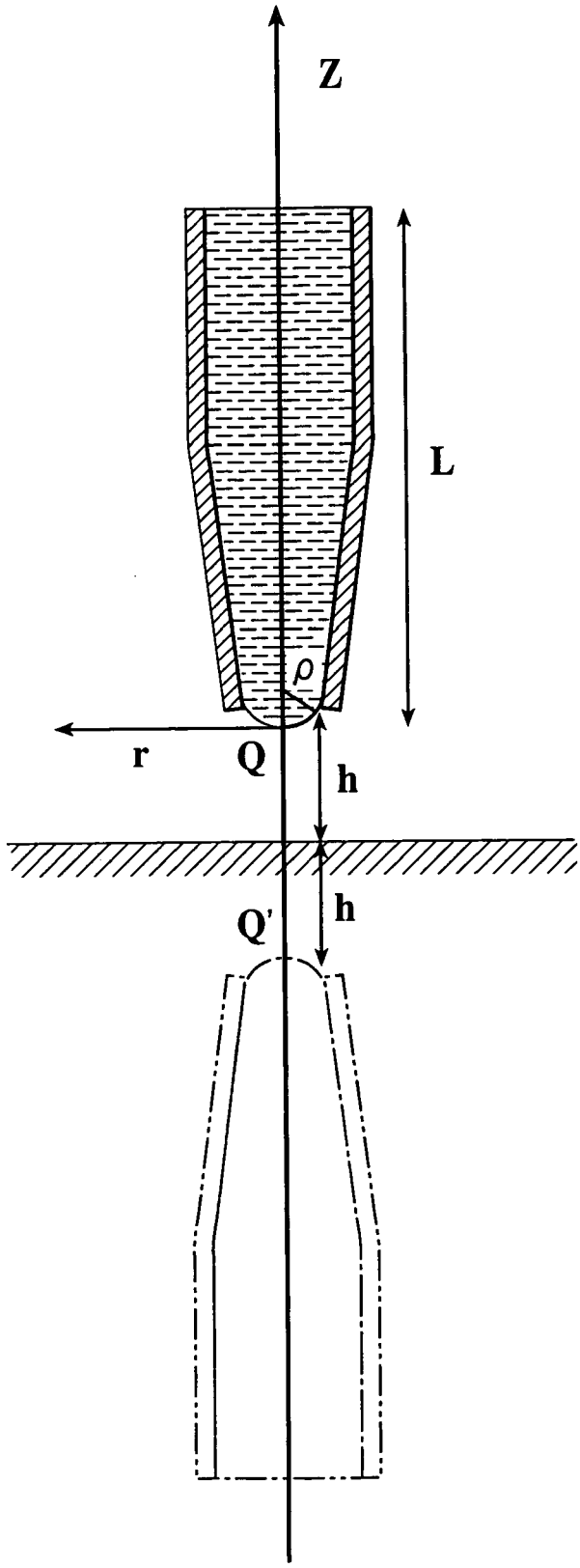
FIG. 20 is a view for describing a calculation of the electric field intensity of the nozzle of the embodiments of the present invention.

Assuming that conductive liquid solution is filled to a nozzle of an inside diameter d and the nozzle is perpendicularly placed with a height h with respect to an infinite plane conductor as a base material at this moment. This state is shown in FIG. 20. At this time, it is assumed that electric charge induced at the nozzle edge portion is concentrated to a hemisphere portion of the nozzle edge, and is approximately expressed in the following equation.

$$Q=2\pi\epsilon_0\alpha Vd \tag{7}$$

where, Q: electric charge induced at the nozzle edge portion [C], $\epsilon_0$: electric constant [F/m], h: distance between nozzle and base material [m], d: diameter of inside of the nozzle [m], and V: total voltage applied to the nozzle [V]. α: proportionality constant dependent on a nozzle shape or the like, taking around 1 to 1.5, especially takes approximately 1 when d<<h.

Further, when the base plate as the base material is a conductive base plate, it is considered that an image charge Q' having opposite sign is induced to the symmetrical position in the base plate. When the base plate is insulating material, similarly an image charge Q' of opposite sign is induced to the symmetrical position determined by a conductivity.

By the way, electric field intensity $E_{loc}$ [V/m] of the edge portion of convex meniscus at the nozzle edge portion is, when a curvature radius of the convex meniscus is assumed to be R [m], given as $$E_{loc} = \frac{V}{kR} \tag{8}$$

where k: proportionality constant, though being different depending on a nozzle shape or the like, taking around 1.5 to 8.5, and in most cases considered approximately 5 (P. J. Birdseye and D. A. Smith, Surface Science, 23 (1970) 198-210).

Now, for ease, we assume d/2=R. This corresponds to a state where the conductive liquid solution rises in a hemisphere shape having the same radius as the nozzle radius according to a surface tension force.

We consider a balance of pressure affecting liquid of the nozzle edge. First, when a liquid area at the nozzle edge portion is assumed to be S [$m^2$], electrostatic pressure is given as $$P_e = \frac{Q}{S}E_{loc} \approx \frac{Q}{\pi d^2/2}E_{loc} \tag{9}$$

From the equations (7), (8) and (9), it is assumed that α=1, $$P_e = \frac{2\varepsilon_0 V}{d/2}\cdot\frac{V}{k\cdot d/2} = \frac{8\varepsilon_0 V^2}{k\cdot d^2} \tag{10}$$

Meanwhile, when a surface tension of the liquid at the nozzle edge portion is $P_s$, $$P_s = \frac{4\gamma}{d} \tag{11}$$

where, λ: surface tension [N/m].

A condition under which jetting of fluid occurs is, since it is a condition where the electrostatic pressure exceeds the surface tension, given as.

$$P_e>P_s \tag{12}$$

By using a sufficiently-small nozzle diameter d, it is possible to make the electrostatic pressure exceed the surface tension.

According to this relational equation, when a relation between V and d is calculated, $$V > \sqrt{\frac{\gamma kd}{2\varepsilon_0}} \tag{13}$$

gives the minimum voltage of jetting. In other words, from the equation (6) and the equation (13), $$h\sqrt{\frac{\gamma\pi}{\varepsilon_0 d}} > V > \sqrt{\frac{\gamma kd}{2\varepsilon_0}} \tag{1}$$

becomes an operation voltage in the present invention.

Dependency of a jetting limit voltage $V_C$ with respect to a nozzle of a certain inside diameter d is shown in the above-mentioned FIG. 9. From this drawing, when a concentration effect of the electric field by the minute nozzle is considered, the fact that the jetting start voltage decreases according to the decrease of the nozzle diameter was revealed.

In a case of making a conventional consideration with respect to the electric field, that is, considering only the electric field which is defined by a voltage applied to a nozzle and by a distance between counter electrodes, as the nozzle becomes smaller, a voltage necessary for jetting increases. On the other hand, focusing on local electric field intensity, due to nozzle miniaturization, it is possible to decrease the jetting voltage.

The jetting according to electrostatic sucking is based on charging of liquid (liquid solution) at the nozzle edge portion. Speed of the charging is considered to be approximately around time constant determined by dielectric relaxation.

$$\tau = \frac{\varepsilon}{\sigma} \tag{2}$$

where, $\epsilon$: dielectric constant of liquid solution [F/m], and $\sigma$: liquid solution conductivity [S/m]. When it is assumed that dielectric constant of the liquid solution is 10 F/m, and liquid solution conductivity is $10^{-6}$ S/m, $\tau=1.854\times10^{-6}$ sec is obtained. Alternatively, when a critical frequency is set to $f_c$[Hz], $$f_c = \frac{\sigma}{\varepsilon} \tag{14}$$

is obtained. It is considered that jetting is impossible because it is not possible to react to the change of the electric field having faster frequency than this $f_c$. When estimation regarding the above-mentioned example is made, the frequency takes around 10 kHz. At this time, in a case of a nozzle radius of 2 μm and a voltage of a little under 500V, it is possible to estimate that current in the nozzle G is $10^{-13}$ $m^3/s$. In a case of the liquid of the above-mentioned example, since it is possible to perform the jetting at 10 kHz, it is possible to achieve minimum jetting amount at one cycle of around 10 fl (femto liter, 1 fl=$10^{-16}$ l).

In addition, each of the above-mentioned embodiments, as shown in FIG. 20, is characterized by a concentration effect of the electric field at the nozzle edge portion and by an act of an image force induced to the counter base plate. Therefore, it is not necessary to have the base plate or a base plate supporting member electrically conductive as conventionally, or to apply a voltage to these base plate or base plate supporting member. In other words, as the base plate, it is possible to use a glass base plate being electrically insulated, a plastic base plate such as polyimide, a ceramics base plate, a semiconductor base plate or the like.

Further, in each of the above-mentioned embodiments, the applying voltage to an electrode may be any of plus or minus.

Further, by maintaining a distance between the nozzle and the base plate not more than 500 [μm], it is possible to make the jetting of the liquid solution easy. Further, preferably, the nozzle is maintained constant with respect to the base material by doing a feedback control according to a nozzle position detection.

Further, the base material may be mounted on a base material holder being either electrically conductive or insulated to be maintained.

Figure 21:
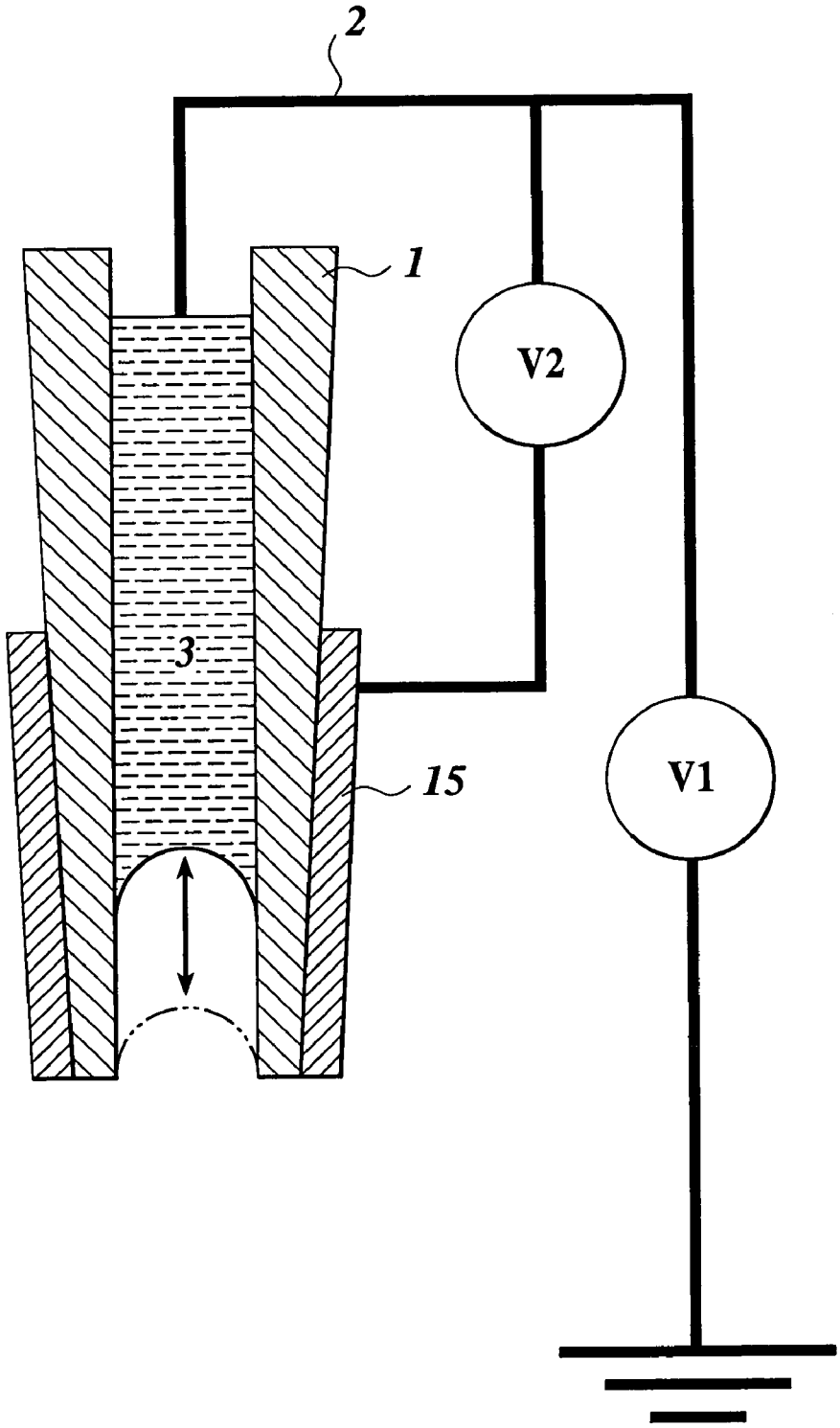
FIG. 21 is a side sectional view of the liquid jetting apparatus as one example of the present invention.

FIG. 21 shows a side sectional view of a nozzle part of the liquid jetting apparatus as one example of another basic example of the present invention. At a side surface portion of a nozzle 1, an electrode 15 is provided, and a controlled voltage is applied between the electrode 15 and an in-nozzle liquid solution 3. The purpose of this electrode 15 is an electrode for controlling Electrowetting effect. When a sufficient electric field covers an insulator structuring the nozzle, it is expected that the Electrowetting effect occurs even without this electrode. However, in the present basic example, by doing the control using this electrode more actively, a role of a jetting control is also achieved. In the case that the nozzle 1 is structured from insulator, a nozzle tube at the nozzle edge portion is 1 μm, a nozzle inside diameter is 2 μm and an applying voltage is 300V, it becomes Electrowetting effect of approximately 30 atmospheres. This pressure is insufficient for jetting but has a meaning in view of supplying the liquid solution to the nozzle edge portion, and it is considered that control of jetting is possible by this control electrode.

The above-mentioned FIG. 9 shows dependency of the nozzle diameter of the jetting start voltage in the present invention. As the nozzle of the liquid jetting apparatus, one which is shown in FIG. 11 is used. As the nozzle becomes smaller, the jetting start voltage decreases, and the fact that it was possible to perform jetting at a lower voltage than conventionally was revealed.

In each of the above-mentioned embodiments, conditions for jetting the liquid solution are respective functions of: a distance between nozzle and base material (h); an amplitude of applying voltage (V); and an applying voltage frequency (f), and it is necessary to satisfy certain conditions respectively as the jetting conditions. Adversely, when any one of the conditions is not satisfied, it is necessary to change another parameter.

Figure 22:
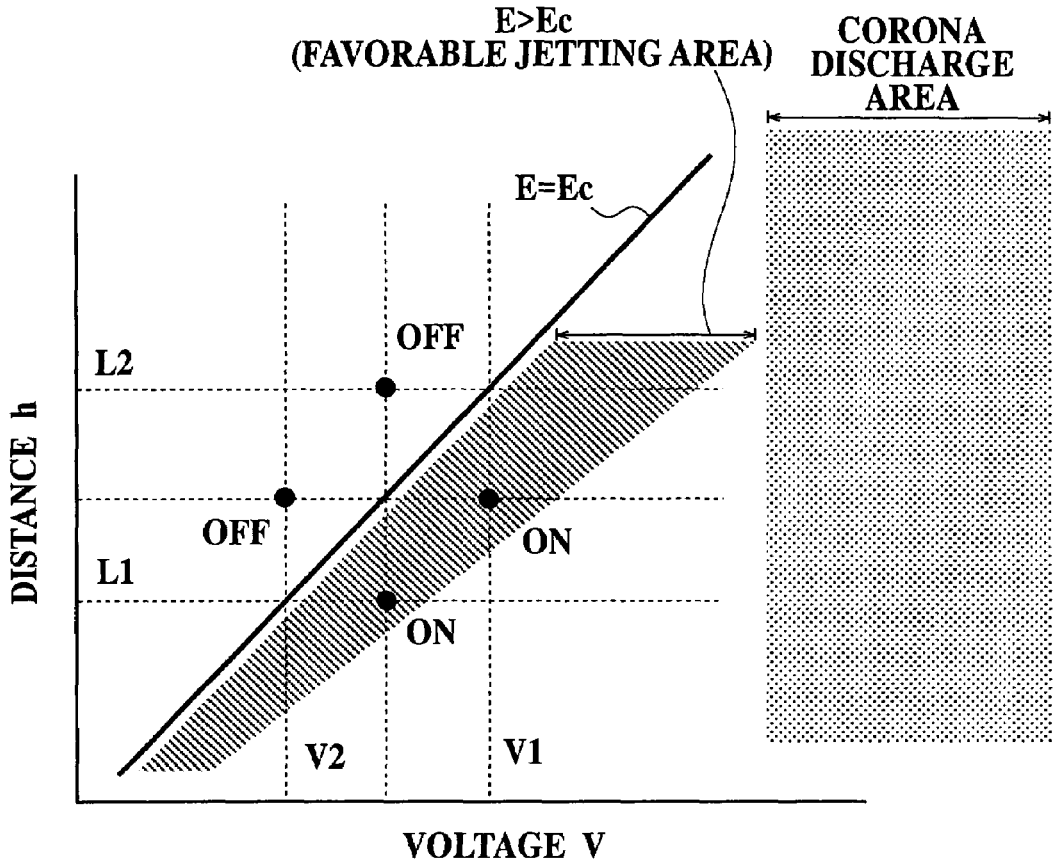
FIG. 22 is a view for describing a jetting condition according to a relation of distance-voltage in the liquid jetting apparatus of the embodiments of the present invention.

This state will be described with reference to FIG. 22.

First, for jetting, a certain critical electric field $E_c$ exists, where jetting is not performed unless the electric field is not less than the electric field $E_c$. This critical electric field is a value changed according to the nozzle diameter, a surface tension of the liquid solution, viscosity or the like, and it is difficult to perform the jetting when the value is not more than $E_c$. At not less than the critical electric field $E_c$, that is, at jetting capable electric field intensity, approximately a proportional relation arises between the distance between nozzle and base material (h) and the amplitude of applying voltage (V), and when the distance between nozzle and base material is shortened, it is possible to make the critical applying voltage V smaller.

Adversely, when the distance between nozzle and base material h is made extremely apart for making the applying voltage V larger, even if the same electric field intensity is maintained, according to an effect such as corona discharge or the like, blowout of fluid droplet, that is, burst occurs.

INDUSTRIAL APPLICABILITY

As described above, the present invention is suitable to jet a droplet for each usage of normal printing as graphic use, printing to special medium (film, fabric, steel plate), curved surface printing, and the like, or patterning coating of wiring, antenna or the like by liquid or paste conductive material, coating of adhesive, sealer and the like for processing use, for biotechnological, medical use, pharmaceuticals (such as one mixing a plurality of small amount of components), coating of sample for gene diagnosis or the like.

The invention claimed is:

1. A liquid jetting apparatus to jet a droplet of a charged liquid solution onto a base material, comprising:

a liquid jetting head comprising a nozzle to jet the droplet from an edge portion, an inside diameter of the edge portion of the nozzle being more than 0.2 μm and being not more than 4 μm, the nozzle being integrally formed with a nozzle plate;

a liquid solution supplying section to supply the liquid solution into the nozzle;

a jetting voltage applying section to apply a jetting voltage to the liquid solution in the nozzle, the jetting voltage applying section comprising a jetting electrode provided as a layer on a back end surface of the nozzle plate, the jetting electrode having an ink passage hole positioned at a border between the liquid solution supplying section and the inside passage; and a convex meniscus forming section to form a state where the liquid solution in the nozzle protrudes from the nozzle edge portion;

wherein the jetting voltage is set to a value in the range that a droplet is capable of being jetted in a state where a convex meniscus by the liquid solution is formed at the edge portion of the nozzle, and a droplet is not jetted in a state where the convex meniscus is not formed.

2. The liquid jetting apparatus of claim 1, further comprising an operation control section to control an application of a driving voltage for driving the convex meniscus forming section and an application of the jetting voltage by the jetting voltage applying section, wherein the operation control section comprises a first jetting control unit to control the application of the driving voltage of the convex meniscus forming section when jetting a droplet while controlling the application of the jetting voltage by the jetting voltage applying section.

3. The liquid jetting apparatus of claim 2, wherein the operation control section comprises a liquid stabilization control section to perform an operation control to draw a liquid level at the nozzle edge portion to an inside after the protruding operation of the liquid solution and the application of the jetting voltage.

4. The liquid jetting apparatus of claim 1, further comprising an operation control section to control a driving of the convex meniscus forming section and a voltage application by the jetting voltage applying section, wherein the operation control section comprises a second jetting control unit to perform a protruding operation of the liquid solution by the convex meniscus forming section and an application of the jetting voltage in synchronization with each other.

5. The liquid jetting apparatus of claim 4, wherein the operation control section comprises a liquid stabilization control section to perform an operation control to draw a liquid level at the nozzle edge portion to an inside after the protruding operation of the liquid solution and the application of the jetting voltage.

6. The liquid jetting apparatus of claim 1, wherein the convex meniscus forming section comprises a piezo element to change a capacity in the nozzle.

7. The liquid jetting apparatus of claim 1, wherein the convex meniscus forming section comprises a heater to generate an air bubble in the liquid solution in the nozzle.

8. The liquid jetting apparatus of claim 1, wherein a jetting voltage V by the jetting voltage applying section satisfies the following equation (1);

$$h\sqrt{\frac{\gamma\pi}{\varepsilon_0 d}} > V > \sqrt{\frac{\gamma k d}{2\varepsilon_0}} \tag{1}$$

where, γ: surface tension of liquid solution [N/m], $\epsilon_0$: electric constant [F/m], d: nozzle diameter [m], h: distance between nozzle and base material [m], k: proportionality constant dependent on nozzle shape (1.5<k<8.5).

9. The liquid jetting apparatus of claim 1, wherein the nozzle is formed with a material having an insulating property which indicates dielectric breakdown strength of not less than 10 kV/mm.

10. The liquid jetting apparatus of claim 1, wherein at least the edge portion of the nozzle is formed with a material having an insulating property which indicates dielectric breakdown strength of not less than 10 kV/mm.

11. The liquid jetting apparatus of claim 1, wherein the liquid solution supplying section comprises a liquid solution room, and the ink passage hole is at a border position between the liquid solution room and the inside passage of the nozzle.

12. The liquid jetting apparatus of claim 1, wherein the inside diameter of the nozzle at the nozzle edge portion and an inside diameter of the inside passage of the nozzle are uniform.

* * * * *